US008244162B2

(12) United States Patent
Takashima

(10) Patent No.: US 8,244,162 B2
(45) Date of Patent: Aug. 14, 2012

(54) IMAGE FORMING APPARATUS AND DETACHABLE BODY

(75) Inventor: Yoshiyuki Takashima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 761 days.

(21) Appl. No.: 12/121,979

(22) Filed: May 16, 2008

(65) Prior Publication Data

US 2008/0298835 A1 Dec. 4, 2008

(30) Foreign Application Priority Data

May 29, 2007 (JP) ..... 2007-142421

(51) Int. Cl.
*G03G 15/08* (2006.01)

(52) U.S. Cl. ..... 399/258; 399/110; 399/111; 399/227

(58) Field of Classification Search ..... 399/110, 399/111, 114, 119, 227, 258
See application file for complete search history.

(56) References Cited

U.S. PATENT DOCUMENTS

| | | | | |
|---|---|---|---|---|
| 6,438,345 | B1 * | 8/2002 | Ban et al. | 399/262 |
| 2007/0104505 | A1 | 5/2007 | Murakami et al. | |
| 2007/0183812 | A1 * | 8/2007 | Takashima et al. | 399/227 |
| 2008/0124105 | A1 * | 5/2008 | Okamoto et al. | 399/51 |

FOREIGN PATENT DOCUMENTS

| | | | |
|---|---|---|---|
| JP | 6365058 | U | 4/1988 |
| JP | 2002341648 | A | 11/2002 |
| JP | 2005-134452 | A | 5/2005 |
| JP | 2005321470 | A | 11/2005 |
| JP | 2006309016 | A | 11/2006 |

OTHER PUBLICATIONS

Australian Office Action dated May 3, 2010 in Australian application No. 2008202211.

Office Action issued on Feb. 7, 2012 in the corresponding Japanese Application No. 2007-142421.

* cited by examiner

*Primary Examiner* — David Gray
*Assistant Examiner* — Barnabas Fekete
(74) *Attorney, Agent, or Firm* — Sughrue Mion, PLLC

(57) ABSTRACT

An image forming apparatus includes a detachable-body mounted member, a detachable body and a sealing portion. The detachable-body mounted member includes a first opening and a first opening-and-closing member that opens and closes the first opening. The detachable body includes a second opening and a second opening-and-closing member. When the detachable body is attached, the second opening allows developer to flow into the first opening. The second opening-and-closing member opens and closes the second opening. When the detachable body is being attached or detached, the sealing portion seals a gap between (i) a front end face of the second opening forming member and (ii) a rear end face of the first opening-and-closing member.

30 Claims, 14 Drawing Sheets

GRk
3
4
5
6
6a
7
7a
8
8a
8b
9
11
11a
11b
11c
12
12a
12b
12c
12d
(-X)
Y
(-Z)
Z
(-Y)
X

IMAGE FORMING APPARATUS AND DETACHABLE BODY

CROSS-REFERENCE TO RELATED APPLICATIONS

This application is based on and claims priority under 35 U.S.C. §119 from Japanese Patent Application No. 2007-142421 filed on May 29, 2007.

BACKGROUND

1. Technical Field

The invention relates to an image forming apparatus including a toner replenishing device that replenishes toner that is used in an operation of forming an image, and particularly, relates to a toner replenishing device including a replenishing-port shutter that opens and closes a toner replenishing port of the toner replenishing device, and an image forming apparatus including the toner replenishing device.

2. Related Art

Generally, an electrophotographic image forming apparatus includes a toner replenishing device that replenishes toner that is used in a developing device when an image is formed. The toner replenishing device has: a replenishing device body to and from which a toner cartridge that accommodates toner therein is attached and detached; a toner replenishing port through which the toner is replenished from the toner cartridge; a replenishing-port shutter that opens and closes the toner replenishing port; and a toner conveying member that conveys the toner supplied from the toner cartridge to a developing device. This toner replenishing device adopts such a technique that when the toner cartridge is slidingly moved in an insertion/pull-out direction, the movement of a cartridge shutter that opens and closes a toner supply port on the toner cartridge is caused to interlock with the movement of the replenishing-port shutter on the image forming apparatus body, thereby suppressing toner leak during toner replenishment.

As the technique of suppressing the toner leak in the toner replenishment, the following technique (J01) has been known.

(J01) Technique described in JP 2005-134452 A (particularly, paragraphs 0094 to 0098 and abstract)

JP 2005-134452 A describes such a technique that when a toner cartridge (Ky, Km, Kc, Kk) is replaced, the movement of a cartridge shutter (141*y*) that is movable between (i) a position where it opens a toner supply port (123*y*) of a toner cartridge (Ky, Km, Kr, Kk) that is opened downward and (ii) a position where it closes the toner supply port (123*y*) is caused to interlock with the movement of a replenishing-port shutter (33*y*) that is movable between a position where it opens a toner replenishing port (31*y*) on an image forming apparatus body (U2) and a position where it closes the toner replenishing port (31*y*), thereby replenishing the toner.

In JP 2005-134452 A, when the toner cartridge (Ky, Km, Kc, Kk) is being inserted in mounting the toner cartridge, a front end of the cartridge shutter (141*y*) in its insertion direction is engaged with a body-side engagement portion (91*y*) and positioned. In this state, when the toner cartridge (Ky, Km, Kc, Kk) is further inserted, the cartridge shutter (141*y*) opens the toner supply port (123*y*). Moreover, when the toner cartridge (Ky, Km, Kc, Kk) is still further inserted, a boss (137*y*) on the toner cartridge (Ky, Km, Kc, Kk) engages with the replenishing-port shutter (33*y*) on the image forming apparatus body (U2). The replenishing-port shatter (33*y*), which has engaged with the boss (137*y*), is inserted and slidingly moved in the insertion direction in accordance with the movement of the toner cartridge (Ky, Km, Kc, Kk), and the toner replenishing port (31*y*) on the image forming apparatus body (U2) is opened. When the replenishing-port shutter (33*y*) is pushed to the open position, the toner supply port (132*y*) and the toner replenishing port (31*y*) overlap each other, and the toner for replenishment is replenished from the toner cartridge (Ky, Km, Kc, Kk) to the image forming apparatus body (U2).

Also, when the toner cartridge (Ky, Km, Kc, Kk) is being pulled out in detaching the toner cartridge, the boss (137*y*) of the toner cartridge (Ky, Km, Kc, Kk) abuts against narrow-width portions (66*y* and 66*y*) of the replenishing-port shutter (33*y*), and the replenishing-port shutter (33*y*) and the toner cartridge (Ky, Km, Kc, Kk) become movable in an interlocking manner in a pull-out direction. When the toner cartridge (Ky, Km, Kc, Kk) is further pulled out in this state, the replenishing-port shutter (33*y*) slidingly moves in accordance with the movement of the toner cartridge (Ky, Km, Kc, Kk) in the pull-out direction, and the toner replenishing port (31*y*) is closed. When the toner cartridge (Ky, Km, Kc, Kk) is still further pulled out and the replenishing-port shutter (33*y*) arrives at the close position where it closes the toner replenishing port (31*y*), the boss (137*y*) on the toner cartridge (Ky, Km, Kc, Kk) is detached from the replenishing-port shutter (33*y*). When the toner cartridge (Ky, Km, Kc, Kk) is pulled out in this state and is slidingly moved in the pull-out direction, the cartridge shutter (141*y*) closes the toner supply port (123*y*), and after the toner supply port (123*y*) is completely closed, the toner cartridge (Ky, Km, Kc, Kk) is detached from the image forming apparatus body (U2).

SUMMARY

According to an aspect of the invention, an image forming apparatus includes a detachable-body mounted member, a detachable body and a sealing portion. The detachable-body mounted member is supported by an image forming apparatus body. The detachable-body mounted member includes a first opening into which developer flows, a first opening forming member formed around the first opening, and a first opening-and-closing member that opens and closes the first opening. The detachable body is attachable to and detachable from the detachable-body mounted member. The detachable body includes an accommodating portion that accommodates the developer therein, a second opening that communicates with the first opening when the detachable body is attached to the detachable-body mounted member, and allows the developer accommodated in the accommodating portion to flow into the first opening, a second opening forming member formed around the second opening, a second opening-and-closing member that opens and closes the second opening. The sealing portion is able to be in contact with at least one of the following (i) and (ii). That is, (i) is the second opening forming member and the first opening-and-closing member, and (ii) is the first opening forming member and the second opening-and-closing member. When the detachable body is being attached or detached from the detachable-body mounted member, the sealing portion seals at least one of the following (iii) and (iv). That is, (iii) is a gap between a front end face of the second opening forming member in a mounting direction along which the detachable body is attached to the detachable-body mounted member and a rear end face of the first opening-and-closing member in the mounting direction, and (iv) is a gap between a rear end face of the first opening forming member in the mounting direction and a front end face of the second opening-and-closing member. The front end face of the second opening forming member, the rear end face of the first opening-and-closing member, the rear end face of the first opening forming member and the front end face of the second opening-and-closing member are substantially perpendicular to the mounting direction.

BRIEF DESCRIPTION OF THE DRAWINGS

Exemplary embodiments of the invention will be described in detail below with reference to the accompanying drawings, wherein:

FIG. 7A is a view showing a state where a cartridge shutter has moved to the close position, and FIG. 7B is a section view taken along the line VIIB-VIIB of FIG. 7A;

FIG. 9A is an enlarged perspective view when the cartridge shutter is viewed from an opposite side to a mounting side, and FIG. 9B is an enlarged perspective view when the cartridge shutter is viewed from the mounting side;

FIG. 10A is a top view, and FIG. 10B is a side view;

FIG. 11A is a top view, and FIG. 11B is a side view;

FIG. 12A is a top view, and FIG. 12B is a side view;

FIG. 13A is a top view, and FIG. 13B is a side view; FIG. 14A is a top view, and FIG. 14B is a side view.

DETAILED DESCRIPTION

Figure 1:
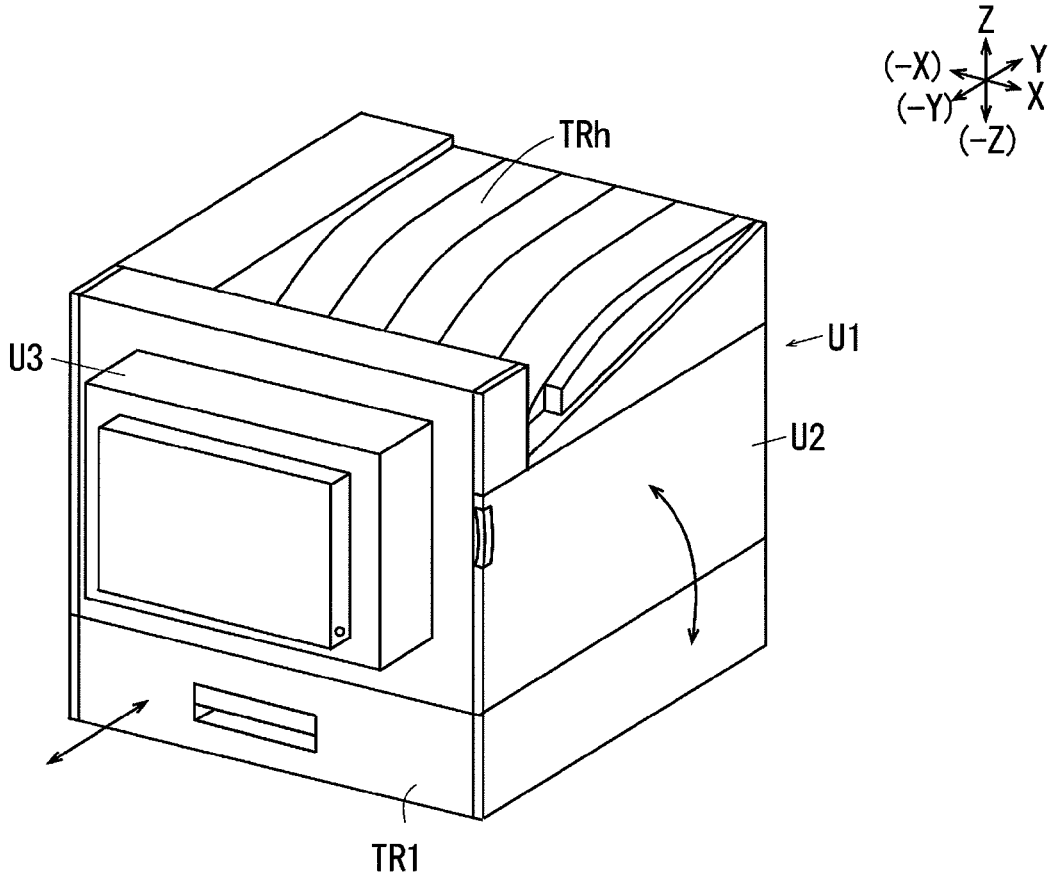
FIG. 1 is a perspective explanatory view of an image forming apparatus of one exemplary embodiment of the invention.

Next, specific examples of exemplary embodiments of the invention will be described with reference to the accompanying drawings. It should be noted that the invention is not limited to the following examples.

In order to facilitate understanding of the following description, in the drawings, the front-and-rear direction is defined as an X-axis direction, the right-and-left direction is defined as a Y-axis direction, and the up-and-down direction is defined as a Z-axis direction. Also, it is assumed that directions or sides represented by arrows X, −X, Y, −Y, Z, and −Z are a front direction, a rear direction, a right direction, a left direction, an up direction, and a down direction, respectively, or are a front side, a rear side, a right side, a left side, an upper side, and an lower side, respectively.

Furthermore, in the drawings, a symbol in which "●" is drawn in "o", means an arrow that directs to from the rear side of a drawing sheet to the front side thereof, and a symbol in which "x" is drawn in "o" means an arrow that directs from the front side of a drawing sheet to turns to the rear side thereof.

In addition, in the following description using the drawings, illustration of members other than those required for description may be omitted appropriately for facilitating understanding.

FIG. 1 is a perspective explanatory view of an image forming apparatus of one exemplary embodiment of the invention.

Figure 2:
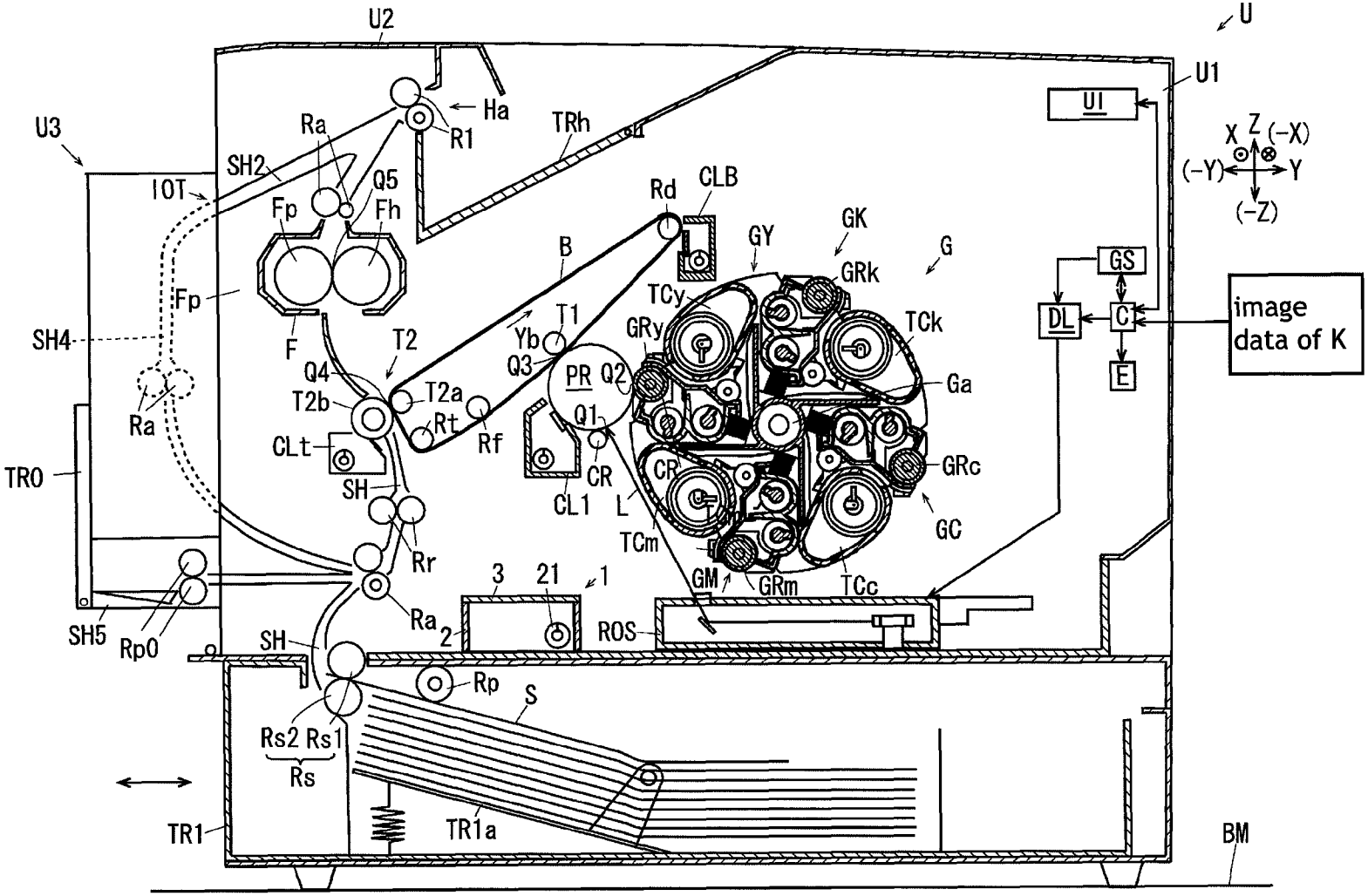
FIG. 2 is an explanatory view of the whole image forming apparatus of the exemplary embodiment of the invention.

FIG. 2 is an explanatory view of the whole image forming apparatus of the exemplary embodiment of the invention.

In FIGS. 1 and 2, a digital printer U that is an example of the image forming apparatus of the exemplary embodiment has an image forming apparatus body U1. On an upper surface of the image forming apparatus body U1, provided is a sheet discharge tray TRh that is an example of a discharge section. A sheet feed cassette TR1 that accommodates recording sheets S on which an image will be recorded is disposed in a lower portion of the printer body U1. Further, a side cover (opening and closing member) U2 that is opened and closed during replacement of internal replaceable members (toner cartridges and the like) is supported in a front central portion (a center portion in the X-plane) of the printer body U1 so as to be rotatable about a center of rotation (not shown).

Referring to FIG. 2, the image forming apparatus body U1 has an operation section UI that is operated by a user for input.

The image forming apparatus body U1 has a control section C, a laser drive circuit DL that is an example of a latent-image-writing-device driving circuit controlled by the control section C, an image processing section GS, a power supply circuit E, etc.

The image processing section GS converts image data input from an external information processing apparatus, etc. into image data for writing to store it temporarily, and outputs the image data to the laser drive circuit DL as image data for latent image formation at a predetermined timing.

The laser drive circuit DL outputs a laser driving signal to a latent-image forming device ROS according to the input image data. The latent-image forming device ROS emits a laser beam (image writing light) L for image writing according to the laser driving signal. Also, the control section C controls the operation of the power supply circuit E that applies a voltage to the operation section UI, the image processing section GS, the laser drive circuit DL, developing rollers GRy to GRk which will be described later, and transfer rollers T1 and T2*b*.

After the surface of an image carrier (photosensitive body) PR that is disposed above the latent-image forming device ROS is uniformly charged by a charging roller CR, the surface is exposed and scanned with the laser beam L of the latent-image forming device ROS in an latent-image writing position Q1, thereby forming an electrostatic latent image. In the case where a full-color image is formed, electrostatic latent images corresponding to images of four colors of K (black), Y (yellow), M (magenta), and C (cyan) are formed in order. Alternatively, in the case where a monochrome image is formed, only an electrostatic latent image corresponding to a K (black) image is formed.

The surface of the image carrier PR in which the electrostatic latent images are formed rotates to move, and passes through a developing region Q2 and a primary transfer region Q3 sequentially.

The rotary-type developing device (detachable-body mounted member) G is disposed above the ROS. The rotary-type developing device G has developing units GK, GY, GM, and GC for four colors of K (black), Y (yellow), M (magenta), and C (cyan) that sequentially and rotationally moves to the developing region Q2 as a rotary shaft Ga rotates. The developing unit GK, GY, GM, GC for each color has a developing-unit body GK1, GY1, GM1, GC1 in which developer is stirred and conveyed, and the developing roller GRk, GRy, GRm, or GRc that convey the developer to the developing region Q2. The developing unit GK, GY, GM, GC for each color develops an electrostatic latent image on the image carrier PR that is passing through the developing region Q2, as a toner image. The developing-unit body GK1, GY1, GM1, GC1 of the developing unit GK, GY, GM, GC is configured so as to be replenished with each color toner from a toner cartridge (detachable body) TCk, TCy, TCm, TCc. Also, the developing device G will be described in detail later.

Referring to FIG. 2, an endless intermediate transfer belt B that is an example of an intermediate transfer body is disposed above the image carrier PR. The intermediate transfer belt B is supported by a drive roller Rd that is an example of a driving member for rotational driving, a primary transfer roller T1 that is an example of a primary transfer unit to which a primary transfer voltage is applied, a tension roller Rt that is an example of a tension generating member that generates a tension in the intermediate transfer belt B, a back-up roller T2*a* that is an example of a facing member that faces a secondary transfer member, and a free roller Rf that supports the intermediate transfer belt B. The respective belt supporting members (Rd, T1, Rf, Rt, and T2*a*) is constituted by the corresponding rollers Rd, T1, Rf, Rt, and T2*a*. Also, the intermediate transfer belt B is rotatably and movably supported by the drive roller Rd, and rotates in the direction represented by an arrow Yb during the image-forming operation.

In the case where a multi-color image, i.e., a full-color image is formed, an electrostatic latent image of a first color is formed in the latent-image writing position Q1, and a toner image of the first color is formed in the developing region Q2. When this toner image passes through the primary transfer region Q3, the toner image is electrostatically and primarily transferred onto the intermediate transfer belt B by the primary transfer roller T1. Thereinafter, similarly, primary toners image of a second color, a third color, and a fourth color are sequentially and overlappingly transferred onto the intermediate transfer belt B that carries the toner image of the first color, thereby eventually forming a full color multi-toner image on the intermediate transfer belt B.

In the case where a monochrome image of a single color is formed, only one developing unit is used, and a monochromatic toner image is primarily transferred onto the intermediate transfer belt B.

After the primary transfer, the surface of the image carrier PR is cleaned by an image carrier cleaner CL1 that is an example of an image carrier cleaning unit. Residual toner adhering to the image carrier PR is recovered by the image carrier cleaner CL1 and then, the image carrier PR is charged again by the charging roller CR.

A secondary transfer roller T2*b* that is an example of a secondary transfer member is disposed in a position where the secondary transfer roller T2*b* faces the back-up roller T2*a*, so as to be movable between (i) a position where the secondary transfer roller is spaced apart from the back-up roller T2*a* and (ii) a position where the secondary transfer roller is brought into contact with the back-up roller T2*a*. A secondary transfer unit T2 is constituted by the back-up roller T2*a* and the secondary transfer roller T2*b*. Further, a secondary transfer region Q4 is formed by a contact region between the back-up roller T2*a* and the secondary transfer roller T2*b*.

A secondary transfer voltage having a polarity opposite to the charging polarity of the toner used in the developing device G is applied to the secondary transfer roller T2*b* from the power supply circuit E. The power supply circuit E is controlled by the control section C.

Referring to FIG. 2, the sheet teed tray TR1 that is an example of a medium accommodating section accommodates the recording sheets S that are an example of a medium for being conveyed to the secondary transfer region Q4. The sheet feed tray TR1 is supported so as to be movable along rails serving as a pair of guide members disposed in the front-and-rear direction on both the right and left sides thereof.

A sheet feeder K is supported in an upper portion of the sheet feed tray TR1 on the sheet feed side. A pick-up roller Rp that is an example of a take-out member of the sheet feeder K takes out a recording sheets S that are loaded on the sheet feed tray TR1 in accordance with a sheet feeding timing. The recording sheet S are separated one by one in a pressure-contact region of a separating roller Rs that is an example of a separating member having a feed roller Rs1 that is an example of a conveying member and a retard roller Rs2 that is an example of a pressing member. The separated recording sheet S is conveyed to a sheet conveying path SH that is an example of a medium conveying path. A recording sheet S in the sheet conveying path SH is conveyed to registration rollers Rr that is an example of a sheet feed timing adjusting member by sheet conveying rollers Ra that is an example of a plurality of medium conveying members disposed along the sheet conveying path SH. The registration rollers Rr convey the recording sheet S to the secondary transfer region Q4 at a predetermined timing.

Also, a recording sheet S that is fed from a manual tray TR0 that is an example of a manual sheet feed section is also conveyed into the image forming apparatus body U1 through a manual sheet conveying path SH5 by manual sheet conveying rollers RP0, and is conveyed to the secondary transfer region Q4 by the sheet conveying rollers Ra and the registration rollers Rr that are disposed along the sheet conveying path SH.

The toner image on the intermediate transfer belt B is secondarily transferred onto the recording sheet S passing through the secondary transfer region Q4 by the secondary transfer unit T2. The toner that remains on the surface of the intermediate transfer belt B after the secondary transfer is recovered and cleaned by a belt cleaner CLB that is an example of an intermediate-transfer-body cleaning member. Further, paper debris or the like that adheres to the secondary transfer roller T2*b* is removed by a secondary-transfer-roller cleaner CLt that is an example of a secondary-transfer-unit cleaning unit.

The recording sheet S to which the unfixed toner image is transferred in the secondary transfer region Q4 is conveyed to a fixing region Q5 in a state where the toner image is unfixed. The fixing device F heats, presses, and fixes the toner image in the fixing region Q5 where a heating roller Fh that is an example of a rotational heating member and a pressing roller Fp that is an example of a rotational pressing member are in contact with each other. The recording sheet S on which the fixed toner image is formed is conveyed by sheet discharge rollers R1 that is an example of a sheet discharge member, and is discharged to the sheet discharge tray TRh from a sheet discharge port Ha.

A main-body sheet inverting path SH2 connected to the sheet discharge port Ha is provided in the printer U. An upper portion of the manual tray TR0 is mounted with a sheet inverting device U3 that is an example of a medium inverting device. An option-sheet inverting path SH4 that is an example of an inverting path connected to the main-body sheet inverting path SH2 is formed in the sheet inverting device U3. Accordingly, in double-side printing, the sheet S on which the toner image is fixed in the fixing region Q5 passes through the main-body sheet inverting path SH2 and the option-sheet inverting path SH4, and is conveyed to the registration rollers Rr, and is conveyed again to the secondary transfer region Q4 in a state where the front and back of the sheet S have been inverted.

A sheet inverting path (SH2+SH4) is constituted by the main-body sheet inverting path SH2 and the option-sheet inverting path SH4.

A sheet conveying member (Rp, Rs, Ra, or R1) is constituted by the pick-up roller Rp, the separating roller Rs, the sheet conveying rollers Ra, and the discharge rollers R1.

(Description of Developing Device G)

Figure 3:
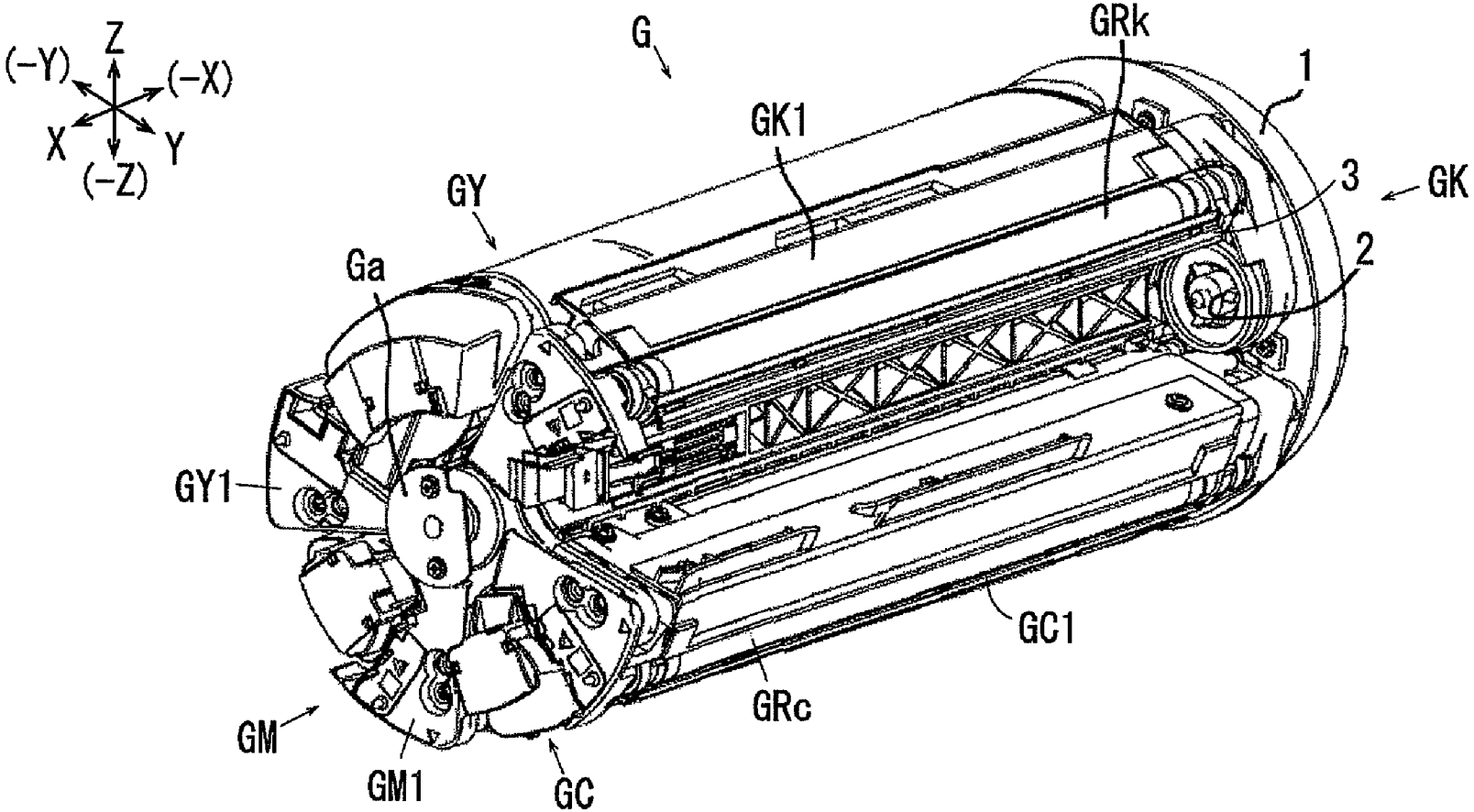
FIG. 3 is a perspective explanatory view of a developing device of the exemplary embodiment, and is a view showing a state where a toner cartridge for black (K) is pulled out of the developing device.

FIG. 3 is a perspective explanatory view of the developing device of the exemplary embodiment, and is a view showing a state where the toner cartridge for black (K) is pulled out of the developing device.

Hereinafter, the rotary-type developing device G of the exemplary embodiment will be described in detail below. Since the developing units GK, GY, GM, and GC for individual colors are configured in the same way, only the developing unit GK for black (K) will be described, and the description about the other developing units GY, GM, and GC will be omitted. Referring to FIG. 3, a disc-like rear wall 1 is formed at a rear end (−X end) of the developing unit GK, which is formed so that the rotary shaft Ga can rotate it. On the front side (X side) of the rear wall 1, formed is a driving-force transmitting portion 2 that transmits a driving force from a motor (not shown) disposed in the image forming apparatus body U to a driving-force transmitted member (not shown) that supports a rear end of the toner cartridge TCk and interlocks with an auger shaft (not shown), formed at the rear end, of the toner cartridge TCk.

In FIG. 3, the position from which the toner cartridge TCk for black (K) is detached is set to a replacement position (an attaching/detaching position) of the toner cartridge TCk, TCy, TCm, TCc.

Figure 4:
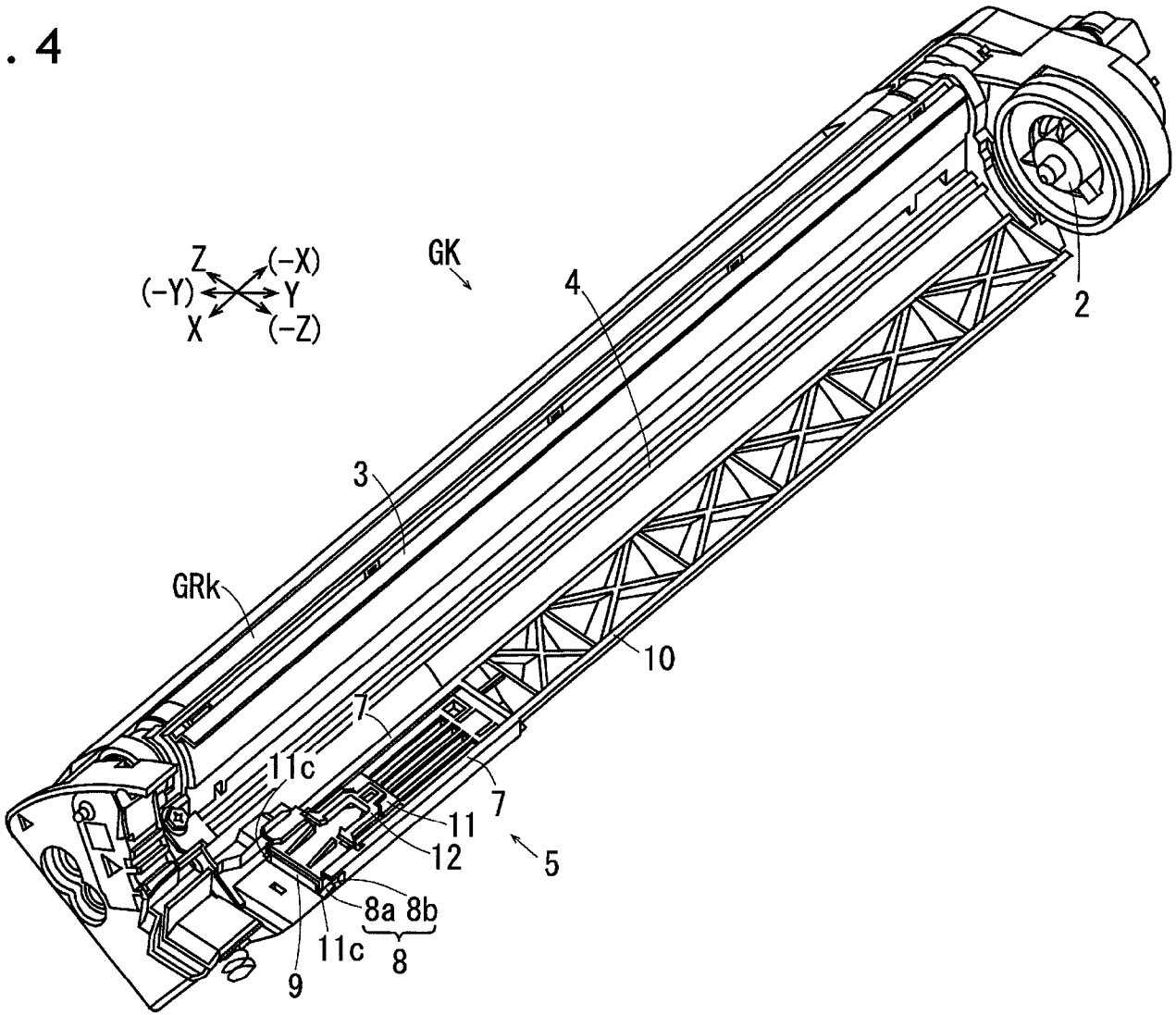
FIG. 4 is an enlarged explanatory view of a developing-unit body of the exemplary embodiment, and is a view showing that a replenishing-port shutter has moved to a close position.

FIG. 4 is an enlarged explanatory view of the developing-unit body of the exemplary embodiment, and is a view showing that a replenishing-port shutter is moved to a close position.

Figure 5:
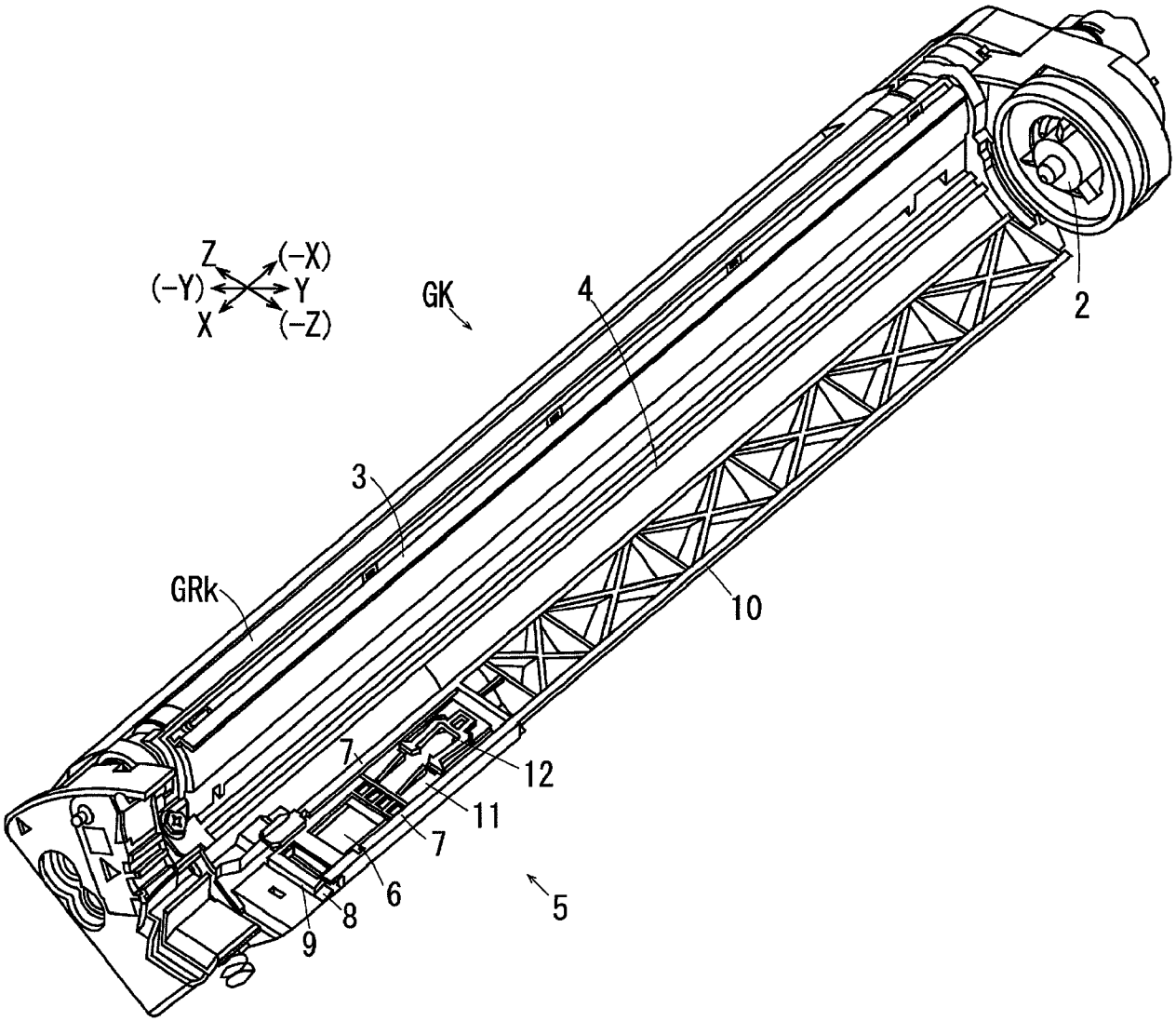
FIG. 5 is an enlarged explanatory view of the developing-unit body of the exemplary embodiment, and is a view showing that the replenishing-port shutter has moved to an open position.

FIG. 5 is an enlarged explanatory view of the developing-unit body of the exemplary embodiment, and is a view showing that the replenishing-port shutter is moved to an open position.

Referring to FIGS. 3 to 5, a first slide rail 3 that extends in the front-and-rear direction (X-axis direction) is formed in an outside upper portion of the developing-unit body GK1 of the developing unit GK. A second slide rail 4 that extends in the front-and-rear direction (X-axis direction) is formed below the first slide rail 3.

Figures 6A, 6B:
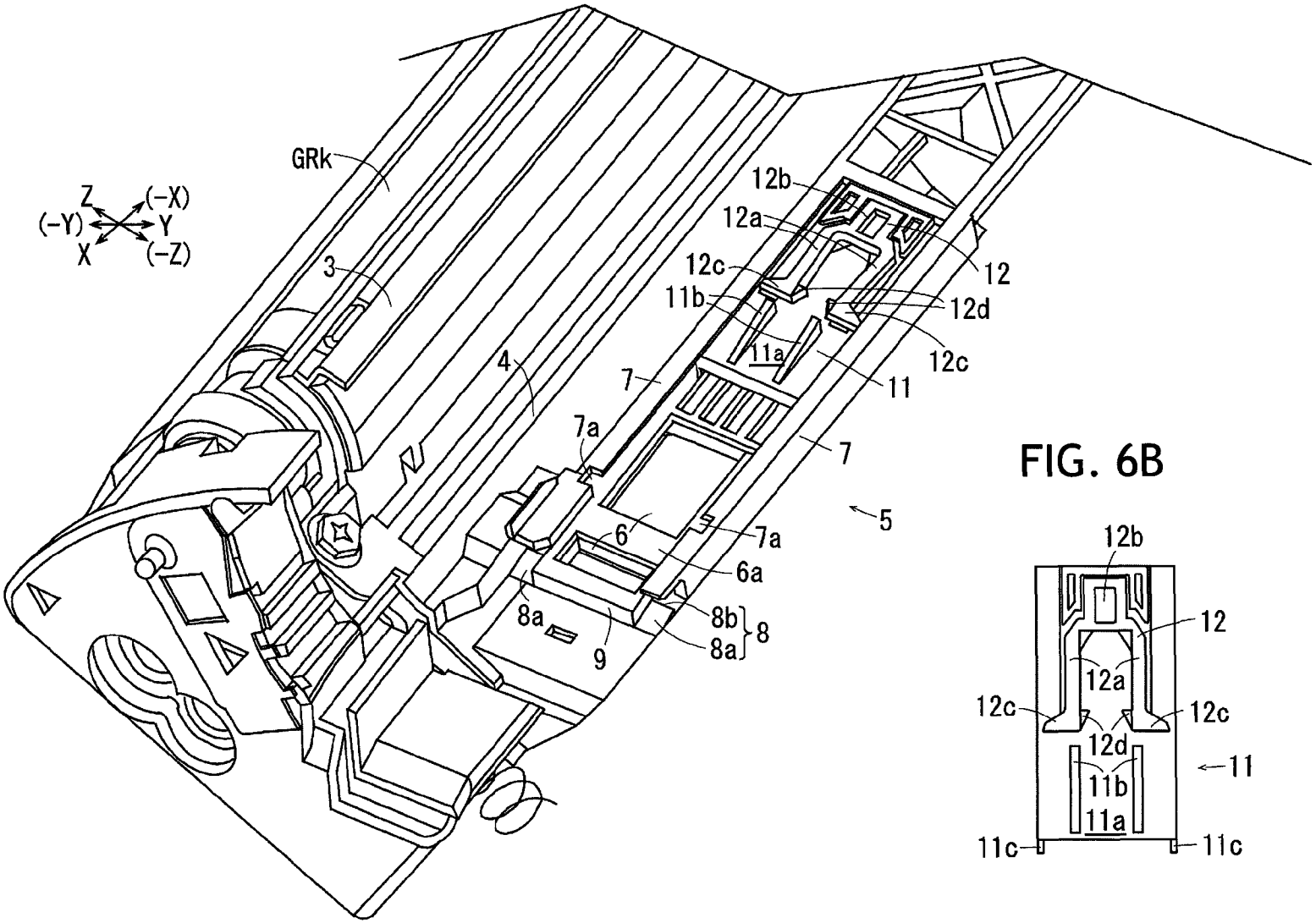
FIGS. 6A and 6B are explanatory views of main portions of the developing-unit body of the exemplary embodiment.

FIGS. 6A and 6B are explanatory views of main portions of the developing-unit body of the exemplary embodiment.

In FIG. 4 to FIGS. 6A and 6B, a replenishing-port forming portion 5 is formed in a lower portion of the developing-unit body GK1 in the vicinity its right end. A front end (+X end) of the replenishing-port forming portion 5 is formed with a toner replenishing port (first opening) 6 to which the toner from the toner cartridge TCk is replenished. The toner replenishing port 6 is formed with a partitioning portion 6*a* for crushing an agglomerated toner. The replenishing-port forming portion 5 is formed with rail-like shutter guide portions 7, 7 that are disposed on the right and left of the toner replenishing port 6 so as to face each other and to extend in the front-and-rear direction (X-axis direction). The front portions of the shutter guide portions 7, 7 of the toner replenishing port 6 are formed with a pair of grooves 7*a*, 7*a*. Below (in −z direction) front ends (+X end) of the pair (only the right shutter guide portion is shown in FIGS. 4 to 6) of right and left shutter guide portions 7, 7, cartridge-shutter locking portions 8, 8 are formed.

The cartridge-shutter locking portions 8, 8 have inclined portions 8*a*, 8*a* that are inclined obliquely upward as they go rearward (−X direction), and hooking portions 8*b* and 8*b* that are formed downward (−Z direction) from the rear ends (−X end) of the inclined portions 8*a*, 8*a*. The front end (+X end) of the replenishing-port forming portion 5 in the portion between the cartridge-shutter locking portions 8, 8 is formed with a cartridge-shutter positioning portion 9 that is formed to be substantially perpendicular to the toner replenishing port 6. A front end face of the replenishing-port forming portion 5 (a front end face of the cartridge-shutter positioning portion 9) is substantially perpendicular to the +X and −X direction (that is, a mounting direction along which the toner cartridge TC is attached to and detached from the developing unit G).

In FIG. 4 and FIGS. 6A and 6B, a shutter member (first opening-and-closing member) 11 is supported by the shutter guide portions 7, 7 so as to be slidingly movable in the front-and-rear direction.

The shutter member 11 has a shutter member body 11*a* that is formed in a flat-plate shape. A pair of engagement-protrusion guide walls 11*b*, 11*b* that extend in the front-and-rear direction (X-axis direction) are formed in the front end of the upper surface (+Z plane) of the shutter member body 11*a* integrally therewith. The right-and-left front ends (+X ends in the Y-axis direction) of the shutter member body 11*a* are formed with a pair of engagement protrusions 11*c*, 11*c* that protrude forward (+X direction), and are inclined obliquely upward as the upper surface goes rearward (−X direction) (see FIGS. 4 and 6B). On the rear side (−X side) of the engagement-protrusion guide walls 11*b*, 11*b*, the upper surface (+Z plane) of the shutter member body 11*a* is formed with a substantially U-shaped shutter-side engagement member (first engagement member) 12. A front end face (+X end face) of the shutter member 11 (shutter member body 11*a*) is substantially perpendicular to the +X and −X direction (that is, the mounting direction).

The shutter-side engagement member 12 has a fixed portion 12*b* that is fixed to and supported by the shutter member 11, and a pair of arms 12*a*, 12*a* that are bifurcated from the fixed portion 12*b* and extend forward (+X direction). The front ends (+X ends) of the arms 12*a*, 12*a* are formed with engagement claws 12*c*, 12*c* that protrude outward and narrow-width portions 12*d*, 12*d* that protrude inward. The arms 12*a*, 12*a* are configured so as to be elastically deformable in directions in which they are brought closer to and separated from each other. Accordingly, the arms 12*b*, 12*b* elastically deforms inward in a state where the engagement claws 12*c*, 12*c* come into contact with inner surfaces of the shutter guide portions 7, 7 in positions other than the grooves 7*a*, 7*a*. Thereby, the distance between the narrow-width portions 12*d*, 12*d* becomes small. Also, in the case where the engagement claws 12*c*, 12*c* are moved to the grooves 7*a*, 7*a*, the arms 12*a*, 12*a* spread outward due to their elastic restoration, and fit into the grooves 7*a*, 7*a*, thereby increasing the distance between the narrowing portions 12*d*, 12*d*, and preventing the shutter-side engagement member 12 from being drawn out forward (+X direction).

Figure 7A:
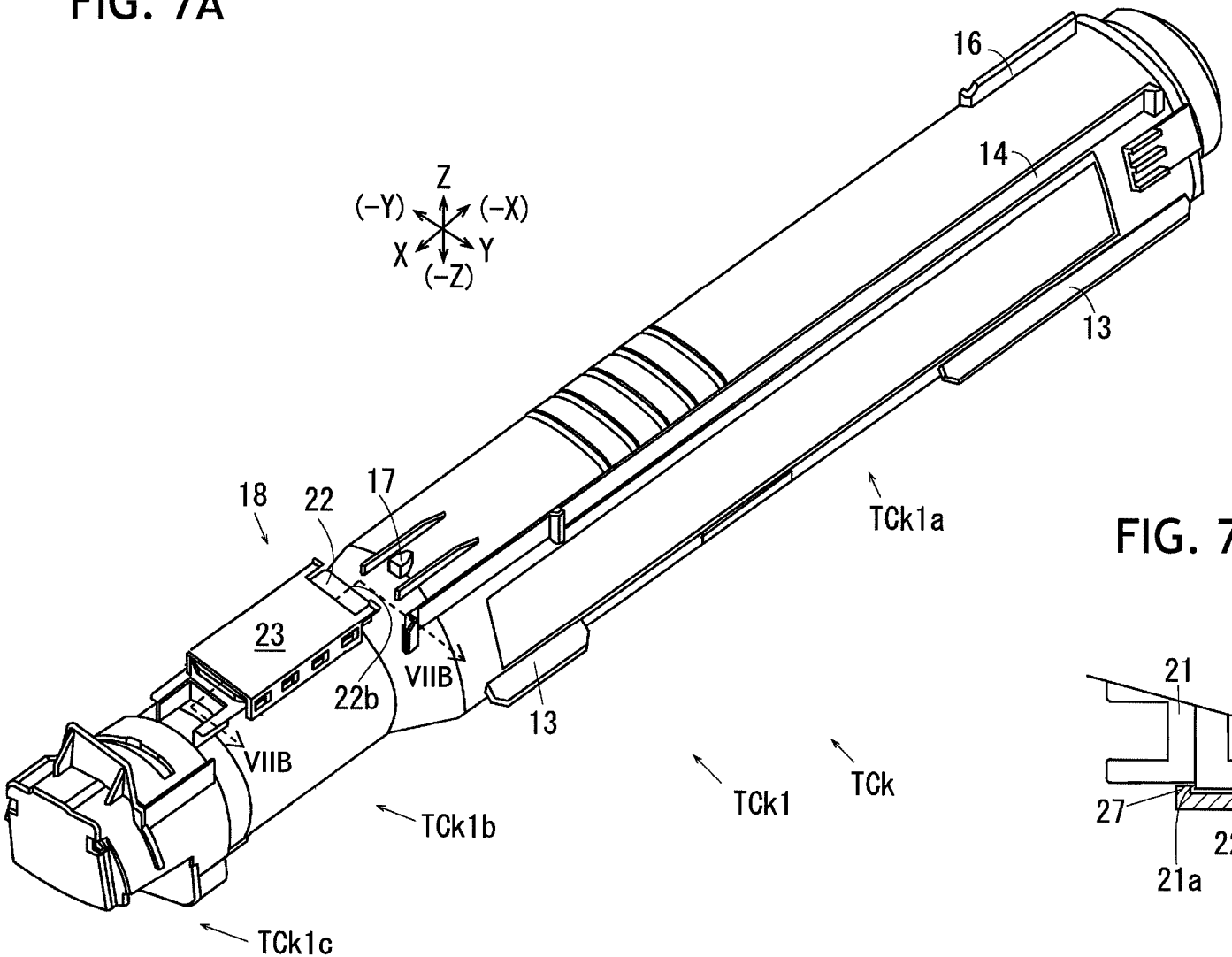
FIGS. 7A and 7B are enlarged explanatory views of the toner cartridge of the exemplary embodiment, and particularly.
Figure 7B:
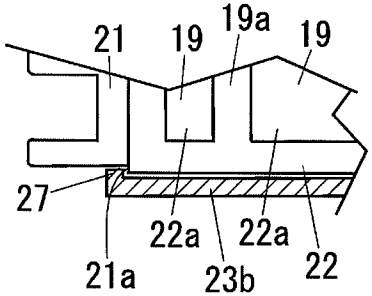

FIGS. 7A and 7B are enlarged explanatory views of the toner cartridge of the exemplary embodiment. Particularly, FIG. 7A is a view showing a state where the cartridge shutter is moved to the close position, and FIG. 7B is a section view taken along the line VIIB-VIIB of FIG. 7A.

Figure 8:
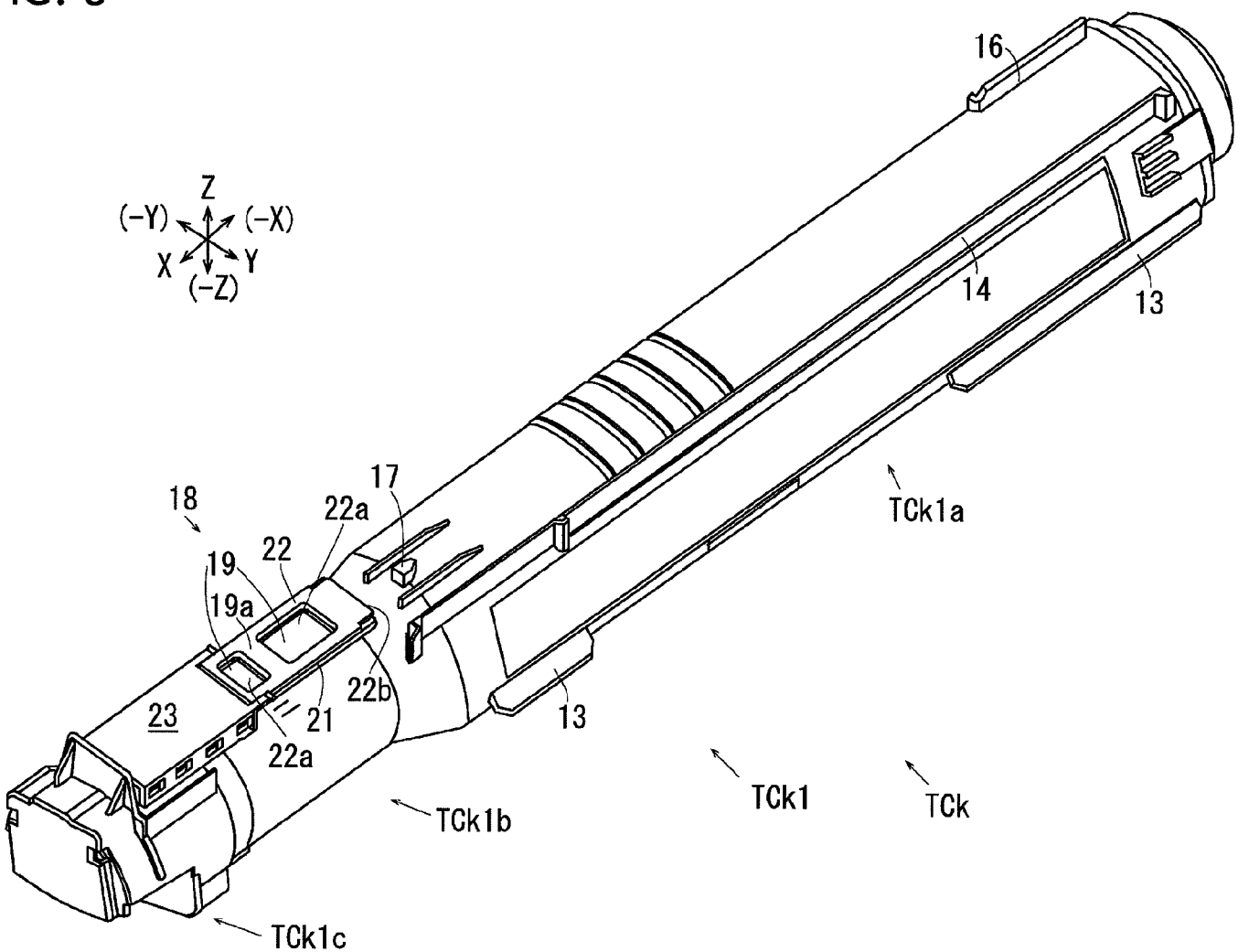
FIG. 8 is an enlarged explanatory view of the toner cartridge of the exemplary embodiment, and is a view showing a state where the cartridge shutter has moved to an open position.

FIG. 8 is an enlarged explanatory view of the toner cartridge of the exemplary embodiment, and is a view showing a state where the cartridge shutter is moved to the open position.

In FIGS. 7A and 7B and FIG. 8, the toner cartridge TCk for black (K) has a developer accommodating portion (accommodating portion) TCk1 that accommodates the developer therein. The developer accommodating portion TCk1 has a rear accommodating portion TCk1*a* that extends in the front-and-rear direction (X-axis direction) and that is formed so as to have a larger external diameter, and a front developer accommodating portion TCk1*b* that has a cylindrical shape and that has a smaller external diameter than that of the rear accommodating portion TCk1*a*. The front end (+X end) of the developer accommodating portion TCk1 is formed with a grip portion TCk1*c* that allows a user to grip and support the toner cartridge TCk when he/she attaches or detaches (inserts or pulls out) the toner cartridge TCk.

The lower portion (−Z-side portion in +Y-side plane) of the right surface of the rear accommodating portion TCk1*a* is formed with first guided portions 13, 13 that are engaged with and guided by the first slide rail 3 of the developing-unit body GK1 when the toner cartridge TCk is being attached to the developing device G. Above the first guided portions 13, 13 (+Z-side), formed is a second guided portion 14 that is guided by the second slide rail 4 of the developing-unit body GK1 when the toner cartridge TCk is being attached to the developing device G. The left end (−Y end in +Z plane) of the upper surface of the rear end of the rear accommodating portion TCk1*a* is formed with a third guided portion 16 that abuts against and is guided by the right side edge (+Y-side edge) 10 of the developing unit GK when the toner cartridge TCk is being attached to the developing device G.

The front end of the upper surface of the developer accommodating portion TCk1 is formed with an engagement protrusion (second engagement member) 17 that protrudes upward (+Z direction).

The upper surface of the front developer accommodating portion TCk1*b* is formed with a supply-port forming portion 18. The supply-port forming portion 19 is formed with a toner supply port (second opening) 19 corresponding to the shape of the toner replenishing port 6. The toner supply port 19 is formed with a partitioning portion 19*a* for crushing an agglomerated toner. A rear end face (−X end face) of the supply-port forming portion 18 is substantially perpendicular to the +X and −X direction (that is, perpendicular to the mounting direction).

The right and left end surfaces of the supply-port forming portion 18 are formed with shutter guide portions 21 (only the right shutter guide portion is shown in the drawing). In FIG. 7B, the front ends of the shutter guide portions 21 are formed with a pair of right and left shutter stoppers 21*a*, 21*a* having a step shape. An elastic sealing member 22 formed of an elastic member is bonded to the upper surface of the supply-port forming portion 18. An elastic sealing member 22 is formed with a through-hole 22*a* corresponding to the toner supply port 19. The elastic sealing member (leakage prevention member) 22 includes a leak-preventing portion (sealing portion) 22*b* that has a rear end (−X end) that protrudes more rearward (−X direction) than the rear end (−X end) of the supply-port forming portion 18 when the leak-preventing portion 22*b* is in an uncompressed state. A cartridge shutter (second opening-and-closing member) 23 engages with the shutter guide portions 21, 21 so as to be slidable in the front-and-rear direction (X-axis direction) between the close position shown in FIGS. 7A and 7B and the open position shown in FIG. 8. The elastic sealing member 22 of the exemplary embodiment is made of, for example, polyurethane rubber or foaming polyurethane, and prevents the toner from leaking from a gap between the cartridge shutter 23 and the supply-port forming portion 18.

Figure 9B:
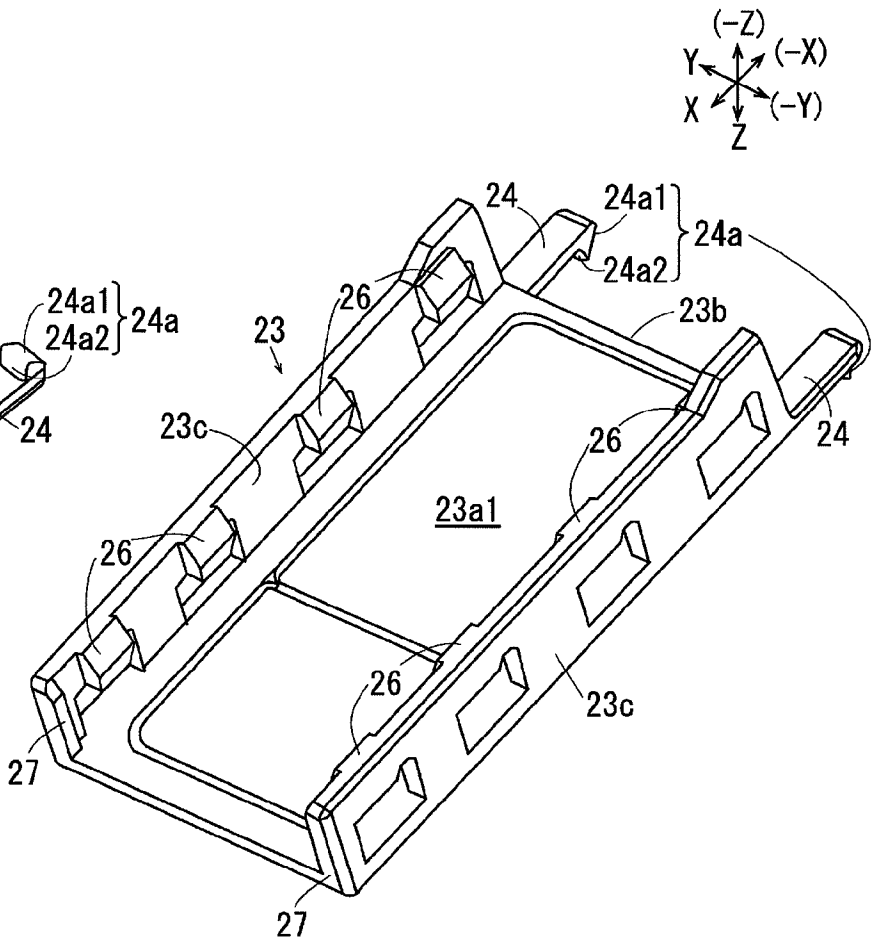
FIGS. 9A and 9B are enlarged explanatory views of the cartridge shutter of the exemplary embodiment, and particularly.
Figure 9A:
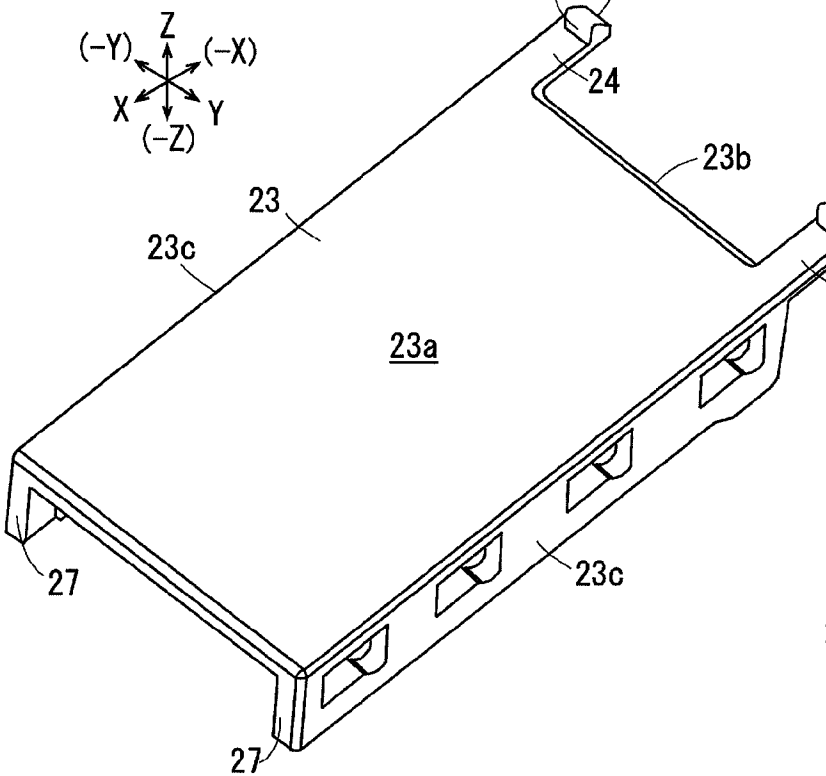

FIGS. 9A and 9B are enlarged explanatory views of the cartridge shutter of the exemplary embodiment. Particularly, FIG. 9A is an enlarged perspective view when the Cartridge shutter is viewed from an opposite side to a mounting side, and FIG. 9B is an enlarged perspective view when the cartridge shutter is viewed from the mounting side.

In FIGS. 9A and 9B, the cartridge shutter 23 has a toner leak-preventing plate 23*a*, a rear end face 23*b* formed in the rear end (−X end) of the toner leak-preventing plate 23*a*, and a pair of side walls 23*c* and 23*c* formed in both the right and left ends (both ends in the Y-axis direction) of the toner leak-preventing plate 23*a*. Both the rear right and left ends (both ends in the Y-axis direction on the −X side) of the toner leak-preventing plate 23*a* are formed with a pair of protruding portions 24, 24 that protrude rearward (−X direction). Distal ends of the protruding portions 24, 24 are provided with locked portions 24*a*, 24*a* that are formed in a claw shape. The locked portions 24*a*, 24*a* have inclined portions 24*a*1, 24*a*1 that are inclined obliquely upward as they go forward (+X direction), and hooking portions 24*a*2, 24*a*2 that are formed downward (−Z direction) from the rear ends (−X end) of the inclined portions 24*a*1, 24*a*1. The rear end face 23*b* of the cartridge shutter 23 is substantially perpendicular to the +X and −X direction (that is, the mounting direction).

In FIG. 7B and FIGS. 9A and 9B, the inner surfaces of the side walls 23*c* and 23*c* are formed with a plurality of shutter guided portions 26 that protrudes inward. The shutter guided portions 26 sandwich the shutter guide portions 21 therebetween, thereby supporting the cartridge shutter 23 so as to be slidingly movable in the front-and-rear direction (X-axis direction). At this time, a rear surface portion 23*a*1 of the lea-preventing plate 23*a* is pressed against the elastic sealing member 22, thereby preventing the toner form leaking. The front ends (+X ends) of the side walls 23*c* and 23*c* are formed with a pair of shutter locking portions 27, 27 having a shape that is bent inward. When the cartridge shutter 23 is moved from the open position to the close position, the shutter locking portions 27, 27 are hooked to the shutter stoppers 21*a*, 21*a* of the shutter guide portions 21, thereby positioning the cartridge shutter 23 in the close position, and preventing the shutter from being drawn out.

Operation of Exemplary Embodiment

Description about Attachment and Detachment of Toner Cartridge

In the printer U of the exemplary embodiment having the above configuration, the toner in the toner cartridge TCk, TCy, TCm, TCc is replenished to the developing unit GK, GY, GM, GC at the time of forming an image. When the toner in the toner cartridge TCk, TCy, TCm, TCc is exhausted, a user pulls out the toner cartridge TCk, TCy, TCm, TCc that has become empty, and inserts a new toner cartridge TCk, TCy, TCm, TCc to replace the previous toner cartridge.

In FIGS. 4, 5, 7A, 7B, and 8, when the toner cartridge TCk is attached to the developing unit GK, the toner cartridge TCk is attached after the side cover U2 of image forming apparatus U is opened. By causing the first guided portions 13, 13 and the second guided portion 14 of the toner cartridge TCk to engage with the first slide rail 3 and the second slide rail 4 of the developing unit GK, and by causing the third guided portion 16 to abut against the right edge (+Y-side edge) of the developing unit GK to insert the toner cartridge rearward (−X direction), the toner cartridge TCk is guided toward the rear end (toward −X end) of the developing unit GK. The toner cartridge TCk that has been guided and inserted to the rear side (−X direction) is attached to the developing unit GK as the driving-force transmitted member (not shown), what is a so-called coupler that is formed in the rear end (−X end) of the toner cartridge meshes with the driving-force transmitting portion 2 of the developing unit GK.

(Details about Attachment of Toner Cartridge)

Figures 10A, 10B:
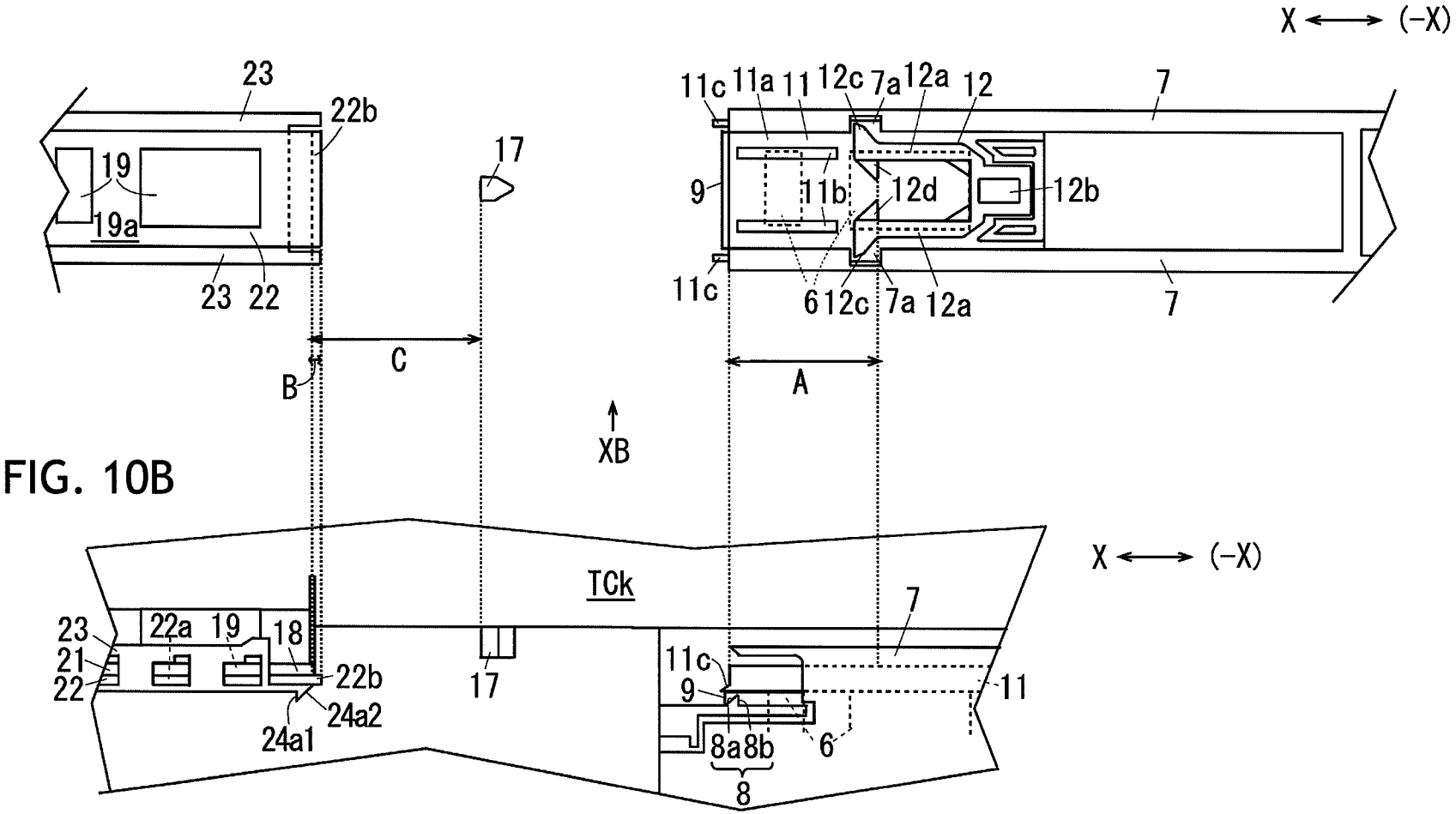
FIGS. 10A and 10B are explanatory views showing a relationship between (i) the cartridge shutter, an elastic sealing member, and engagement protrusions of the toner cartridge, and (ii) the shutter member on the developing unit, immediately after it is started to insert the toner cartridge into the developing unit, and particularly.

FIGS. 10A and 10B are explanatory views showing a relationship between (i) the cartridge shutters the elastic sealing member, and the engagement protrusions of the toner cartridge and (ii) the shutter member on the developing unit, immediately after it is started to insert the toner cartridge into the developing unit. Particularly, FIG. 10A is a top view, and FIG. 10B is a side view.

Figure 11A:
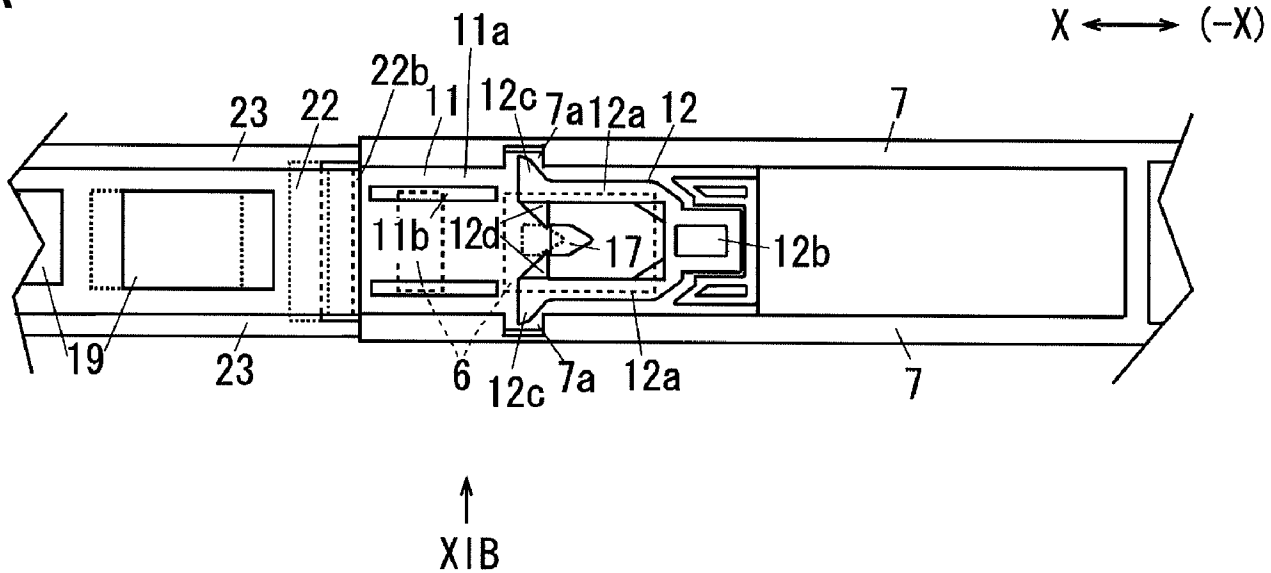
FIGS. 11A and 11B are explanatory views showing the relationship between (i) the cartridge shutter, the elastic sealing member, and the engagement protrusions of the toner cartridge, and (ii) the shutter member on the developing unit, in a state where the toner cartridge is further pushed in the state shown in FIGS. 10A and 10B and the cartridge shutter is in contact with the shutter member, and particularly.
Figure 11B:
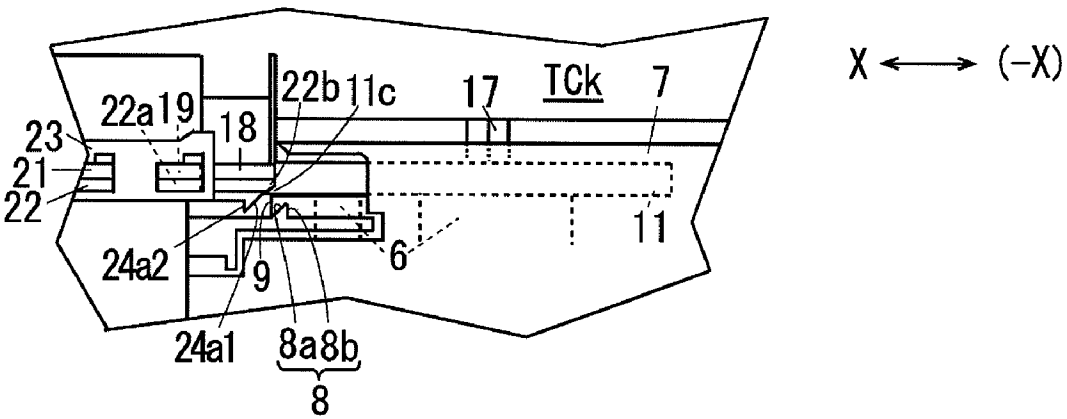

FIGS. 11A and 11B are explanatory views showing the relationship between (i) the cartridge shutter, the elastic sealing member and the engagement protrusions of the toner cartridge and (ii) the shutter member on the developing unit, in a state where the toner cartridge is pushed in the state shown in FIGS. 10A and 10B and the cartridge shutter is in contact with the shutter member. Particularly, FIG. 11A is a top view, and FIG. 11B is a side view.

Figure 12A:
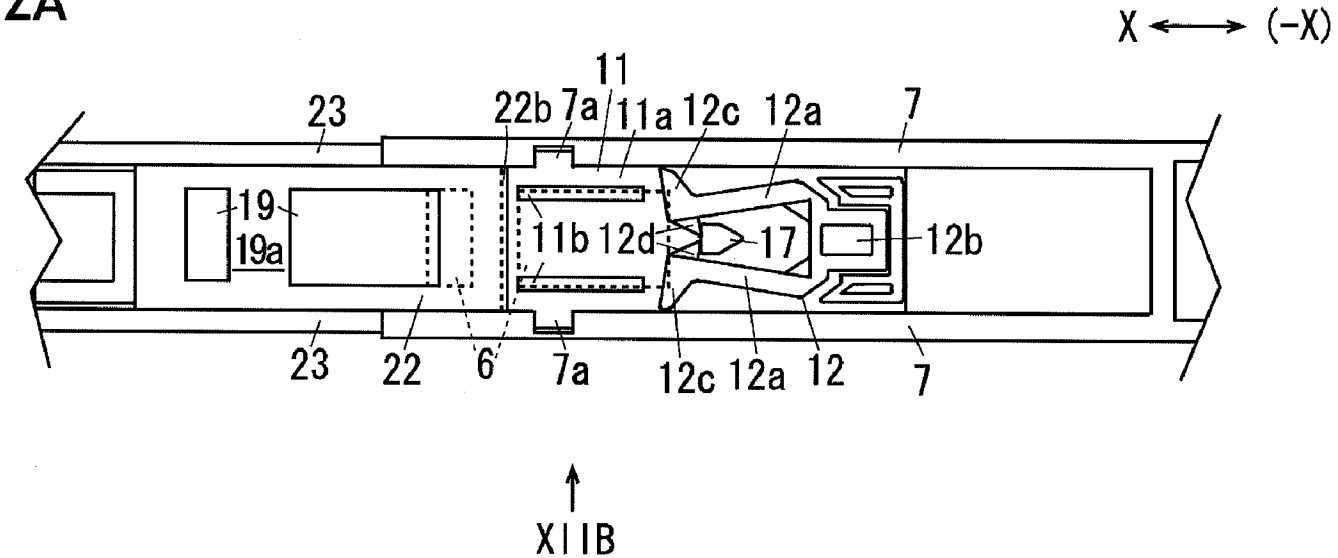
FIGS. 12A and 12B are explanatory views showing the relationship between (i) the cartridge shutter, the elastic sealing member, and the engagement protrusions of the toner cartridge and (ii) the shutter member on the developing unit, in a state where the toner cartridge is further pushed in the state shown in FIGS. 11A and 11B and the shutter member is slightly moved rearward, and particularly.
Figure 12B:
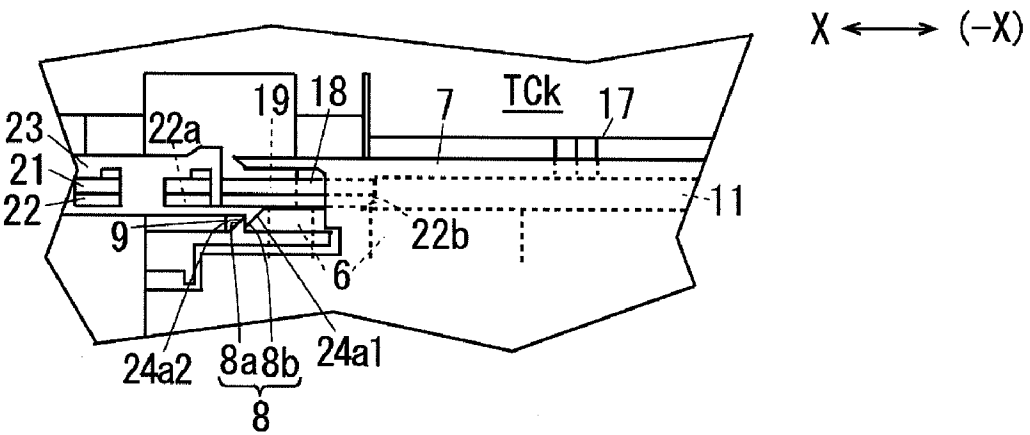

FIGS. 12A and 12B are explanatory views showing the relationship between (i) the cartridge shutter, the elastic sealing member and the engagement protrusions of the toner cartridge and (ii) the shutter member on the developing unit, in a state where the toner cartridge is pushed in the state shown in FIGS. 11A and 11B and the shutter member is slightly moved rearward. Particularly, FIG. 12A is a top view, and FIG. 12B is a side view.

Figure 13A:
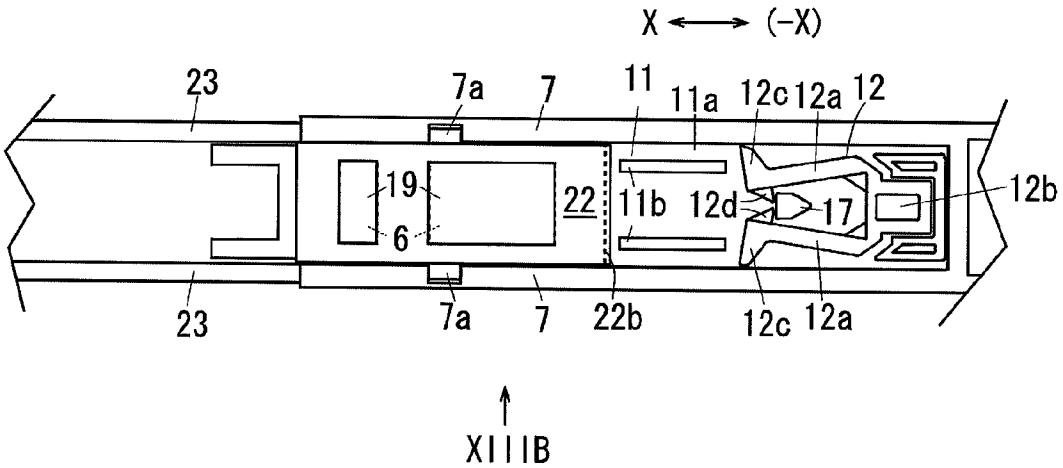
FIGS. 13A and 13B are explanatory views showing the relationship between (i) the cartridge shutter, the elastic sealing member, and the engagement protrusions of the toner cartridge and (ii9 the shutter member on the developing unit, in a state where the toner cartridge is further pushed in the state shown in FIGS. 12A and 12B and the shutter member is moved to the open position, and particularly.
Figure 13B:
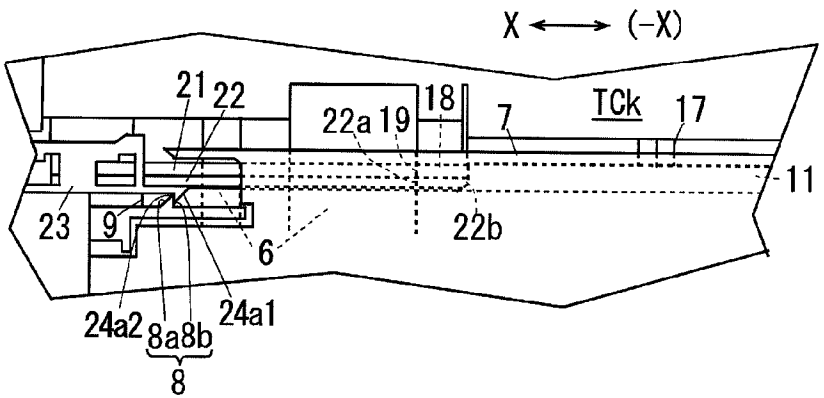

FIGS. 13A and 13B are explanatory views showing the relationship between (i) the cartridge shutter, elastic sealing member and the engagement protrusions of the toner cartridge and (ii) the shutter member on the developing unit, in a state where the toner cartridge is pushed in the state shown in FIGS. 12A and 12B and the shutter member is moved to the open position. Particularly, FIG. 13A is a top view, and FIG. 13B is a side view.

Next, a process in which the toner cartridge TCk, TCy, TCm, TCc of the exemplary embodiment is attached and detached from the developing unit GK, GY, GM, GC will be described in detail with reference to FIGS. 10A and 10B to FIGS. 14A and 14B. In the following description of the process of mounting and demounting (attaching and detaching) the toner cartridge, only attachment and detachment of the toner cartridge TCk for K (black) will be described because the processes of attaching and detaching the toner cartridges for K, Y, M, and C are the same, and description on the attaching and detaching of the toner cartridges for the other colors (Y, M, and C) will be omitted.

In FIGS. 10A and 10B, before the toner cartridge TCk is inserted into the developing unit GK, the cartridge shutter 23 is positioned in the close position where the shutter locking portions 27, 27 are hooked to the shutter stoppers 21*a*, 21*a* of the shutter guide portions 21 (see FIGS. 7A and 7B) and where the toner supply port 19 is closed.

Also, before the toner cartridge TCk is inserted into the developing unit GK, the distal ends of the engagement claws 12*c*, 12*c* of the shutter member 11 fits into the pair of grooves 7*a*, 7*a* of the shutter guide portions 7, 7, and the shutter member 11 is locked in the close position where the shutter member 11 closes the toner replenishing port 6.

Accordingly, even if the toner supply port 19 and the toner replenishing port 6 turn sideways in the attaching/detaching position of the toner cartridge TCk as in this exemplary embodiment, it is possible to prevent the toner in the toner cartridge TCk and the toner in the developing unit GK from leaking to the outside.

When the toner cartridge TCk is pushed in more rearward than its position shown in FIGS. 10A and 10B, the engagement protrusion 17 of the toner cartridge TCk comes into contact with the front ends (+X ends) of the narrow-width portions 12*d*, 12*d* of the shutter member 11 in a position indicated by the fine broken lines of FIG. 11A. When the narrow-width portions 12*d*, 12*d* are pressed in rearward (−X direction) by the rear end (−X end) of the engagement protrusion 17 in this state, the pair of arms 12*a*, 12*a* elastically deform outward, thereby increasing the spacing between the pair of arms 12*a*, 12*a*. When the spacing between the pair of arms 12*a*, 12*a* increases, the engagement protrusion 17 passes therethrough to the rear side (−X side) of the pair of arms 12*a*, 12*a*. When the engagement protrusion 17 completely passes, the gap between the narrow-width portions 12*d*, 12*d* returns to its original width due to the elastic restoration of the arms 12*a*, 12*a*.

In FIGS. 11A and 11B, when the toner cartridge TCk is further pushed in more rearward (−X direction) after the arms 12*a*, 12*a* returns to the original width due to its elastic restoration, the leak-preventing portion 22*b* that protrudes toward the rearward (−X direction) of the elastic sealing member 22 of the toner cartridge TCk comes into contact with the front end (+X end) of the shutter member 11. At this time, the inclined portions 24$a$1, 24$a$1 and the engagement protrusions 11$c$, 11$c$, which are shown in FIG. 11B, face each other.

When the toner cartridge TCk is further pushed in rearward (−X direction) in this state, the leak-preventing portion 22$b$ of the elastic sealing member 22 is pressed against the front end (+X end) of the shutter member 11 and is compressed. In the state of FIGS. 11A and 11B, a part (particularly, the leak-preventing portion 22$b$) of the elastic sealing member 22 is in contact with the shutter member 11 and the supply-port forming portion 18 and the leak-preventing portion 22$b$, which is being compressed, seals a gap between the shutter member 11 and the supply-port forming portion 18. In other words, in the state of FIGS. 11A and 11B, the part of the elastic sealing member 22 is elastically compressed between the gap between the shutter member 11 and the supply-port forming portion 18.

In FIGS. 10A and 10B, the toner cartridge TCk and the shutter member 11 of the exemplary embodiment are set so as to satisfy the following relational expression:

$$A<C<A+B$$

where A denotes a length from the rear end (−X end) of the narrow-width portions 12$d$, 12$d$ of the shutter-side engagement member 12 to the front end (+X end) of the shutter member 11 (that is, a distance between an engagement position between the shutter-side engagement member 12 and the engagement protrusion 17 in a state where the toner cartridge TC is attached to the developing unit G and the front end face (+X end face) of the shutter member 11. In other words, A may be a distance between a portion of the shutter member 11 (shutter member body 11$a$) where the shutter member 11 and the elastic sealing member 22 are in contact with each other and the engagement position between the shutter-side engagement member 12 and the engagement protrusion 17), B denotes a length (natural length) of the leak-preventing portion 22$b$ in the front-and-rear direction (X-axis direction) (that is, a distance between the front end face (+X end face) of the supply-port forming portion 18 and the rear end face (−X end face) of the leak-preventing portion 22$b$, and C denotes a length from the front end (+X end) of the engagement protrusion 17 to the rear end (−X end) of the supply-port forming portion 18 (that is, a distance between the rear end face (−X end face) of the supply-port forming portion 18 and the engagement position between the shutter-side engagement member 12 and the engagement protrusion 17 in the state where the toner cartridge TC is attached to the developing unit G. Accordingly, since the relation C<A+B is satisfied, even if the toner cartridge TCk is stopped during the attachment operation, the engagement protrusion 17 is retained by the narrow-width portions 12$d$, 12$d$. Therefore, if the length of the leak-preventing portion 22$b$, which is being compressed, is defined as B', the leak-preventing portion 22$b$ is held in a state where the relation C=A+B'(B'<B) is satisfied. Consequently, since the leak-preventing portion 22$b$ is held in the compressed state, more reliable sealing can be made.

When the toner cartridge TCk is pushed in more rearward than its position shown in FIGS. 11A and 11B, the front end (+X end) of the shutter member 11 is pushed by the rear end (−X end) of the elastic sealing member 22, and thereby the shutter member 11 moves rearward (−X direction), which results in the state shown in FIGS. 12A and 12B.

When the shutter member 11 starts to move rearward (−X direction) due to the pressing force of the elastic sealing member 22, the pair of arms 12$a$, 12$a$ elastically deform inward, and the engagement claws 12$c$, 12$c$ are released from the pair of grooves 7$a$, 7$a$. When the engagement claws 12$c$, 12$c$ are released from the pair of grooves 7$a$, 7$a$, the shutter member 11 is guided rearward (−X direction) by the shutter guide portions 7, 7 in a state where the distal ends of the engagement claws 12$c$, 12$c$ come into contact with the shutter guide portions 7, 7, and where the pair of arms 12$a$, 12$a$ elastically deform inward.

Further, in FIG. 12B, the shutter member 11 moves rearward (−X direction) while the inclined portions 24$a$1, 24$a$1 and the engagement protrusions 11$c$, 11$c$ face each other. When the inclined portions 24$a$1, 24$a$1 reach the position of the inclined portions 8$a$, 8$a$, the inclined portions 24$a$1, 24$a$1 abut against the inclined portions 8$a$, 8$a$ of the cartridge-shutter locking portions 8, 8.

When the toner cartridge TCk is pushed in more rearward (−X direction) in this state, the locked portions 24$a$, 24$a$ move obliquely upward along the inclination of the inclined portions 8$a$, 8$a$ while the locked portions 24$a$, 24$a$ elastically deform.

Then, the rear end face 23$b$ of the cartridge shutter 23 come into contact with the cartridge-shutter positioning portion 9, and thereby, the rearward (−X direction) movement of the cartridge shutter 23 is regulated. Further, at the same time when the rear end face 23$b$ comes into contact with the positioning portion 9, the locked portions 24$a$, 24$a$ reach the rear side (−X side) of the inclined portions 8$a$, 8$a$. Thereby, the locked portions 24$a$, 24$a$, which are elastically deformed, are elastically restored to their original state, and the front ends (+X ends) of the hook portions 24$a$2, 24$a$2 engage with the rear ends (−X ends) of the hooking portions 8$b$ and 8$b$. Accordingly, the cartridge shutter 23 is restricted in its movement in the front-and-rear direction (+X-axis direction), and is therefore positioned (locked).

When the toner cartridge TCk is pushed in more rearward (−X-axis direction) in the state where the cartridge shutter 23 is restricted in its movement in the front-and-rear direction (X-axis direction), the supply-port forming portion 18 and the elastic sealing member 22 move rearward (−X direction) while they slide relatively to the cartridge shutter 23, and the toner supply port 19 closed by the cartridge shutter 23 is opened.

Also, in the developing unit GK, the shutter member 11 is pushed by the elastic sealing member 22, and moves rearward (−X direction). Therefore, the toner replenishing port 6 closed by the shutter member 11 is opened.

In the developing unit GK, when the shutter member 11 is pushed by the elastic sealing member 22 and moves rearward (−X direction) and then the toner replenishing port 6 is opened, the boundary portion between the rear end (−X end) of the elastic sealing member 22 and the front end (+X end) of the shutter member 11 passes through an opening portion of the toner replenishing port 6. At this time, the portion between the rear end (−X end) of the elastic sealing member 22 and the front end (+X end) of the shutter member 11 is sealed by the leak-preventing portion 22$b$ that is being compressed. Accordingly, in the exemplary embodiment, when the toner cartridge TC is in the replacement position (see FIG. 3) where the toner cartridge TC is replaced, the force that causes the toner to flow back from the toner replenishing port 6 toward the toner cartridge TC acts due to the gravity. However, the boundary portion between the rear end (−X end) of the elastic sealing member 22 and the front end (+X end) of the shutter member 11 is sealed by the leak-preventing portion 22$b$ that has been compressed. Therefore, the toner in the developing unit GK can be prevented from leaking through the gap and from being scattered into the image forming apparatus body U1.

In FIGS. 13A and 13B, when the toner cartridge TCk is pushed in more rearward than its position shown in FIGS.

12A and 12B and inserted to its final position, the shutter member 11 moves to the open position (the position shown in FIGS. 5 and FIGS. 13A and 13B), and the toner supply port 19 of the toner cartridge TCk communicates with the toner replenishing port 6 of the developing unit GK. Accordingly, the toner can be supplied from the toner cartridge TCk into the developing unit GK.

As mentioned above, in the developing unit GK of the exemplary embodiment, only by the user's action of inserting the toner cartridge TCk in one direction (here, −X direction), the shutter member 11 of the developing unit GK can be moved from the close position (the position shown in FIG. 4) to the open position (the position shown in FIG. 5 and FIGS. 13A and 13B) while it can be prevented the toner accommodated in the developing unit GK from being scatter. Also, the cartridge shutter 23 of the toner cartridge TCk can be moved from the close position (the position shown in FIGS. 7A and 7B) to the open position (the position shown in FIG. 8).

(Process of Detaching of Toner Cartridge)

Figure 14A:
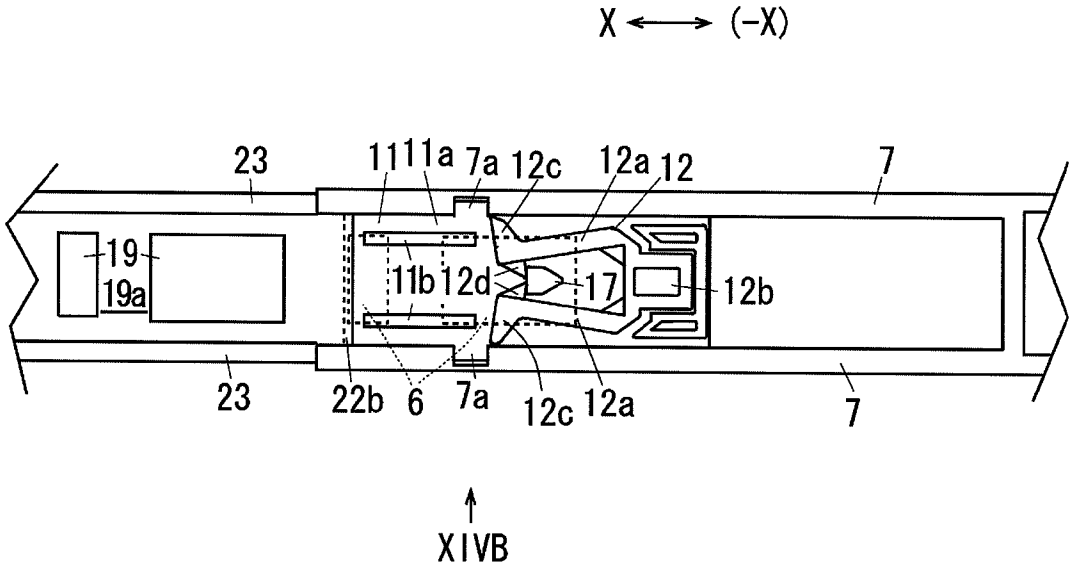
FIGS. 14A and 14B are explanatory views showing the relationship between (i) the cartridge shutter, the elastic sealing member, and the engagement protrusions of the toner cartridge and (ii) the shutter member on the developing unit, in a state where arms of the shutter member are deformed during detachment of the toner cartridge, and particularly.
Figure 14B:
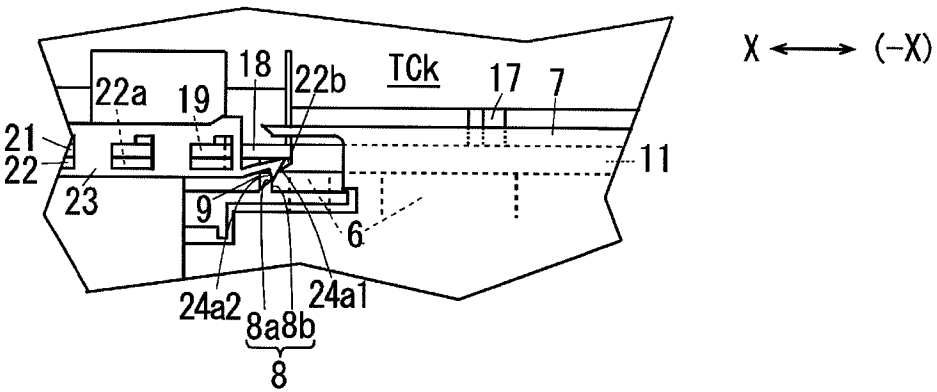

FIGS. 14A and 14B are explanatory views showing the relationship between (i) the cartridge shutter, the elastic sealing member and the engagement protrusions of the toner cartridge and (ii) the shutter member on the developing unit in detaching the toner cartridge, in a state where the arms of the shutter member are being deformed. Particularly, FIG. 14A is a top view, and FIG. 14B is a side view.

When the toner cartridge TCk becomes empty and then it is started to pull out the toner cartridge TCk for the replacement of the toner cartridge TC, the toner cartridge TCk moves forward while being supported by the first slide rail 3 of the developing unit GK and the right edge (+X-side edge) of the second slide rail 4. Accordingly, the arms 12*a*, 12*a* elastically deforms inward, and the spacing between the narrow-width portions 12*d*, 12*d* is kept small due to the contact between the distal ends of the engagement claws 12*c*, 12*c* and the inner surfaces of the shutter guide portions 7. Therefore, after it is started to pull out the toner cartridge TCk in the state shown in FIGS. 13A and 13B, the engagement protrusion 17 abuts against the rear ends (−X ends) of the narrow-width portions 12*d*, 12*d* of the shutter-side engagement member 12 as shown in FIGS. 14A and 14B, and the engagement protrusion 17 pushes the narrow-width portions 12*d*, 12*d* forward (+X direction) without coming off forward (+X direction). Accordingly, the shutter member 11 moves forward (+X direction) as the engagement protrusion 17 moves forward (+X direction), and closes the toner replenishing port 6.

At this time, in the exemplary embodiment, the length A, the length B, and the length C are set to satisfy the relation C<A+B, and the engagement protrusion 17 is locked by the narrow-width portions 12*d*, 12*d* and is prevented from coming off.

Accordingly, the leak-preventing portion 22*b* that can deform elastically is pressed against the front end (+X end) of the shutter member 11 and is therefore compressed. When the length of the leak-preventing portion 22*b*, which is being compressed, is defined as B', the leak-preventing portion is held in a state where the relation C=A+B'(B'<B) is satisfied. Therefore, in the exemplary embodiment, when the toner cartridge TCk is being detached, the portion between the shutter member 11 and the elastic sealing member 22 is always reliably sealed by the leak-preventing portion 22*b*, which is being compressed, during the movement of the toner cartridge TCk. As a result, the toner accommodated in the developing unit GK can be prevented from leaking through the gap, and from being scattered into the image forming apparatus body U1.

Some image forming apparatus of the related art may have such a configuration that a replenishing-port shutter on a main body is pulled to a close position by a spring, thereby closing a replenishing port. In this configuration, when the toner cartridge is pulled out quickly, a gap may be created between the shutter on the main body and a sealing member if the toner cartridge is pulled out at a speed faster than the sliding operation of the replenishing-port shutter by the movement of the shutter by the spring. However, by setting the replenishing-port shutter and the sealing member to a given positional relationship as in this the exemplary embodiment, a gap can be prevented from being created between the replenishing-port shutter and the sealing member.

When the toner cartridge TCk is pulled out up to the position shown in FIGS. 14A and 14B from the state of FIGS. 13A and 13B, the toner supply port 19 is closed completely, and the toner replenishing port 6 is not yet closed completely.

In FIG. 14B, the shutter member 11 that has slidingly moved forward (+X direction) jumps up the inclined portions 24*a*1, 24*a*1, which engage with the hook portions 9*b* and 9*b*, if the inclined upper surfaces of the engagement protrusions 11*c*, 11*c* abut against the inclined portions 24*a*1, 24*a*1 of the cartridge shutter 23 locked to the cartridge-shutter locking portions 8, 8. As a result, the locked portions 24*a*, 24*a* of the cartridge shutter 23 deform elastically, and the locking by the cartridge-shutter locking portions 8, 8 is released.

Further, at the same time when the locking of the locked portions 24*a*, 24*a* is released, the pair of right and left shutter stoppers 21*a*, 21*a*, having the step shape, of the shutter guide portions 21 of the toner cartridge TCk that slidingly moves forward (+X direction) is hooked to the shutter locking portions 27, 27 of the cartridge shutter 23, and the cartridge shutter 23 closes the toner supply port 19 of the toner cartridge TCk.

Accordingly, in the state of FIGS. 14A and 14B, the cartridge shutter 23 is released from the locking to the developing unit GK, and the shutter locking portions are hooked to the shutter stoppers 21*a*, 21*a* of the toner cartridge TCk. Therefore, as the toner cartridge TCk is pulled out, the toner cartridge begins to move forward (+X direction).

When the toner cartridge TCk is pulled out in the state of FIGS. 14A and 14B, the engagement claws 12*c*, 12*c* of the shutter member 11 move to the positions of the grooves 7*a*, 7*a*. When the engagement claws 12*c*, 12*c* of the shutter member 11 move to the position of the grooves 7*a*, 7*a*, the engagement claws 12*c*, 12*c* move outward due to the elastic restoration of the pair of arms 12*a*, 12*a*, and fit into the pair of grooves 7*a*, 7*a*. Accordingly, the toner replenishing port 6 is completely closed by the shutter member 11, and the shutter member 11 is positioned in the close position (the position shown in FIG. 4).

Then, when the toner cartridge TCk is pulled out forward (+X direction) in the state where the shutter member 11 is positioned in the close position, the engagement protrusion 17 abut against the rear end (−X end) of the narrow-width portions 12*d*, 12*d*. Since the engagement claws 12*c*, 12*c* fit into the grooves 7*a*, 7*a* and are positioned therein, when the toner cartridge TCk is further pulled out forward (+X direction) from the position where the engagement protrusion 17 abuts agaist the rear ends (−X ends) of the narrow-width portions 12*d*, 12*d*, the spacing between the narrow-width portions 12*d*, 12*d* becomes large and the engagement protrusion 17 passes to the front (+X-side) of the narrow-width portions 12*d*, 12*d*. At this time, the engagement protrusion 17 comes off to the front side (+X direction) of the narrow-width portions 12*d*, 12*d*, and the abutment between the rear end (−X end) of the elastic sealing member 22 and the front end (+X end) of the shutter member 11 is released. Then, by further pulling out the toner cartridge TCk, the toner cartridge TCk is detached from the developing unit GK.

Accordingly, as mentioned above, in the developing unit GK of the exemplary embodiment, only by the user's action of pulling out the toner cartridge TCk in the one direction (here, +X-direction), scattering of the toner accommodated in the developing unit GK can be suppressed, and the shutter member 11 of the developing unit GK can be moved from the open position (the position shown in FIG. 5) to the close position (the position shown in FIG. 4). Furthermore, the cartridge shutter 23 of the toner cartridge TCk can be moved from the open position (the position shown in FIG. 8) to the close position (the position shown in FIGS. 7A and 7B).

(Modifications)

Although the exemplary embodiment of invention has been described in detail, the invention is not limited thereto. Various modifications can be made thereto within the scope of the gist of the invention set forth in claims. Modifications (H01) and (H02) of the invention are illustrated below.

(H01) In the above embodiment, the rotary digital printer U has been illustrated as an image forming apparatus. However, the invention is not limited thereto. For example, used as an image forming apparatus may be a facsimile machine, a printer, or a complex machine having all or a plurality of functions thereof, which uses a toner cartridge that can be replaced by attachment and detachment. Further, the invention is not limited to a color-image forming apparatus, and may be configured by a monochrome-image forming apparatus. Furthermore, the invention is not limited to a so-called rotary image forming apparatus, and may also be applied to a tandem-type image forming apparatus or the like.

(H02) In the above embodiment, the gap between the front end (X end) of the shutter member 11 and the rear end (−X end) of the toner cartridge TCy to TCk is sealed by adhering the elastic sealing member 22 having the leak-preventing portion 22*b* that protrudes rearward (−Xs direction), to the supply-port forming portion 18. However, instead of adhering the elastic sealing member 22, a leak-preventing portion that can be compressed may be provided in the front end (X end) of the shutter member 11, and the leak-preventing portion may seal the gap between the front end (X end) of the shutter member 11 and the rear end (−X end) of the toner cartridge TCy to TCk.

(H03) Also, the elastic sealing member 22 may be adhered to the front end face (+X end face) of the cartridge-shutter positioning portion 9 or the rear end face 23*b* of the cartridge shutter 23, instead of being adhered to the supply-port forming portion 18. In this case, the elastic sealing member 22 may be able to be in contact with the front end face (+X end face) of the cartridge-shutter positioning portion 9 and the rear end face 23*b* of the cartridge shutter 23. Also, when the toner cartridge TC is being attached to or detached from the developing unit G, the elastic sealing member 22 may seal a gap between the front end face (+X end face) of the cartridge-shutter positioning portion 9 and the rear end face 23*b* of the cartridge shutter 23 or may be elastically compressed in the gap between the front end face (+X end face) of the cartridge-shutter positioning portion 9 and the rear end face 23*b* of the cartridge shutter 23.

What is claimed is:

1. An image forming apparatus comprising:

a detachable-body mounted member that is supported by an image forming apparatus body and includes a first opening into which developer flows, a first opening forming member formed around the first opening, a first opening-and-closing member that opens and closes the first opening;

a detachable body that is attachable to and detachable from the detachable-body mounted member and includes an accommodating portion that accommodates the developer therein, a second opening that communicates with the first opening when the detachable body is attached to the detachable-body mounted member, and allows the developer accommodated in the accommodating portion to flow into the first opening, a second opening forming member formed around the second opening, and a second opening-and-closing member that opens and closes the second opening; and a sealing portion that is able to be in contact with at least one of (i) and (ii), (i) being the second opening forming member and the first opening-and-closing member, and (ii) being the first opening forming member and the second opening-and-closing member, wherein when the detachable body is being attached or detached from the detachable-body mounted member, the sealing portion seals at least one of (iii) and (iv), (iii) being a gap between a front end face of the second opening forming member in a mounting direction along which the detachable body is attached to the detachable-body mounted member and a rear end face of the first opening-and-closing member in the mounting direction, (iv) being a gap between a rear end face of the first opening forming member in the mounting direction and a front end face of the second opening-and-closing member, and the front end face of the second opening forming member, the rear end face of the first opening-and-closing member, the rear end face of the first opening forming member and the front end face of the second opening-and-closing member are substantially perpendicular to the mounting direction.

2. The image forming apparatus according to claim 1, further comprising:

a first engagement member that is disposed in the first opening-and-closing member; and a second engagement member that is disposed in the detachable body and on a front side of the second opening in the mounting direction, wherein when the detachable body is being detached from the detachable-body mounted member, the second engagement member engages with the first engagement member and is moved to a certain position so that the first opening-and-closing member closes the first opening, when the detachable body is being attached to the detachable-body mounted member, the second opening forming member compresses the sealing portion and the front end face of the second opening forming member presses the rear end face of the first opening-and-closing member to open the first opening, and the following relationship is satisfied $$C<A+B$$

where A denotes a distance between (i) an engagement position between the first and second engagement members in a state where the detachable body is attached to the detachable-body mounted member and (ii) the rear end face of the first opening-and-closing member, B denotes a distance between the front end face of the second opening forming member and a front end face of the sealing portion in the mounting direction in an uncompressed state, and C denotes a distance between (i) the front end face of the second opening forming member and (ii) the engagement position between the first and second engagement members in the state where the detachable body is attached to the detachable-body mounted member.

3. The image forming apparatus according to claim 1, wherein the sealing portion is provided around the second opening.

4. The image forming apparatus according to claim 3, wherein the detachable-body mounted member includes a rotary-type developing device.

5. The image forming apparatus according to claim 1, wherein the sealing portion is disposed at the rear end face of the first opening-and-closing member in the mounting direction.

6. The image forming apparatus according to claim 5, wherein the detachable-body mounted member includes a rotary-type developing device.

7. The image forming apparatus according to claim 1, wherein the detachable-body mounted member includes a rotary-type developing device.

8. The image forming apparatus according to claim 1, wherein the sealing portion is at least one of a foam and a rubber.

9. The image forming apparatus according to claim 1, wherein the sealing portion either i) protrudes from the second opening forming member by a distance in the mounting direction when the detachable body is being attached to the detachable-body mounted member or ii) protrudes from the first opening forming member by a distance in a direction opposite the mounting direction when the detachable body is being attached to the detachable-body mounted member.

10. The image forming apparatus according to claim 1, wherein the sealing portion is in contact with the (i) when the first opening is opened and is in contact with the (ii) when the second opening is opened.

11. The image forming apparatus according to claim 1, wherein the sealing portion is in contact with the (i) when the first opening-and-closing member is locked and is in contact with the (ii) when the second opening-and-closing member is locked.

12. An image forming apparatus comprising:

a detachable-body mounted member that is supported by an image forming apparatus body and includes a first opening into which developer flows, a first opening forming member formed around the first opening, and a first opening-and-closing member that opens and closes the first opening;

a detachable body that is attachable to and detachable from the detachable-body mounted member and includes an accommodating portion that accommodates the developer therein, a second opening that communicates with the first opening when the detachable body is attached to the detachable-body mounted member, and allows the developer accommodated in the accommodating portion to flow into the first opening, a second opening forming member formed around the second opening, and a second opening-and-closing member that opens and closes the second opening; and a sealing portion that is able to be in contact with at least one of (i) and (ii), (i) being the second opening forming member and the first opening-and-closing member, and (ii) being the first opening forming member and the second opening-and-closing member, wherein when the detachable body is being attached or detached from the detachable-body mounted member, the sealing portion is able to be elastically-compressed in at least one of (iii) and (iv), (iii) being a gap between a front end face of the second opening forming member in a mounting direction along which the detachable body is attached to the detachable-body mounted member and a rear end face of the first opening-and-closing member in the mounting direction, and (iv) being a gap between a rear end face of the first opening forming member in the mounting direction and a front end face of the second opening-and-closing member in the mounting direction, and the front end face of the second opening forming member, the rear end face of the first opening-and-closing member, the rear end face of the first opening forming member and the front end face of the second opening-and-closing member are substantially perpendicular to the mounting direction.

13. The image forming apparatus according to claim 12, wherein the sealing portion is in contact with the (i) when the first opening is opened and is in contact with the (ii) when the second opening is opened.

14. The image forming apparatus according to claim 13, further comprising:

a first engagement member that is disposed in the first opening-and-closing member; and a second engagement member that is disposed in the detachable body and on a front side of the second opening in the mounting direction, wherein when the detachable body is being detached from the detachable-body mounted member, the second engagement member engages with the first engagement member and is moved to a certain position so that the first opening-and closing member closes the first opening, when the detachable body is being attached to the detachable-body mounted member, the second opening forming member compresses the sealing portion and the front end face of the second opening forming member presses the rear end face of the first opening-and-closing member to open the first opening, and the following relationship is satisfied $$C<A+B$$

where A denotes a distance between (i) an engagement position between the first and second engagement members in a state where the detachable body is attached to the detachable-body mounted member and (ii) the rear end face of the first opening and-closing member, B denotes a distance between the front end face of the second opening forming member and a front end face of the sealing portion in the mounting direction in an uncompressed state, and C denotes a distance between (i) the front end face of the second opening forming member and (ii) the engagement position between the first and second engagement members in the state where the detachable body is attached to the detachable-body mounted member.

15. The image forming apparatus according to claim 13, wherein the sealing portion is provided around the second opening.

16. The image forming apparatus according to claim 15, wherein the detachable-body mounted member includes a rotary-type developing device.

17. The image forming apparatus according to claim 13, wherein the sealing portion is disposed at the rear end face of the first opening-and-closing member in the mounting direction.

18. The image forming apparatus according to claim 17, wherein the detachable-body mounted member includes a rotary-type developing device.

19. The image forming apparatus according to claim 13, wherein the detachable-body mounted member includes a rotary-type developing device.

20. The image forming apparatus according to claim 13, wherein the sealing portion is at least one of a foam and a rubber.

21. The image forming apparatus according to claim 13, wherein the sealing portion either i) protrudes from the second opening forming member by a distance in the mounting direction when the detachable body is being attached to the detachable-body mounted member or ii) protrudes from the first opening forming member by a distance in a direction opposite the mounting direction when the detachable body is being attached to the detachable-body mounted member.

22. The image forming apparatus according to claim 13, wherein the sealing portion is in contact with the (i) when the first opening-and-closing member is locked and is in contact with the (ii) when the second opening-and-closing member is locked.

23. A detachable body configured to be supported by an image forming apparatus body and to be attached to and detached from a detachable-body mounted member that includes a first opening into which developer flows, a first opening-and-closing member that opens and closes the first opening and a first engagement member disposed in the first opening-and-closing member, the detachable body comprising:

a second opening forming member formed around a second opening, wherein when the detachable body is attached to the detachable-body mounted member, the second opening communicates with the first opening and allows developer accommodated in the detachable body into the first opening;

a second engagement member that is disposed on a front side of the second opening in a mounting direction along which the detachable body is attached to the detachable-body mounted member, wherein when the detachable body is being detached from the detachable-body mounted member, the second engagement member engages with the first engagement member and is moved to a certain position where the first opening-and-closing member closes the first opening; and a sealing portion that is able to be in contact with (i) a front end face of the second opening forming member in the mounting direction and (ii) a rear end face of the first opening-and-closing member in the mounting direction, and is able to be elastically-compressed between the front end face of the second opening forming member and the rear end face of the first opening-and closing member, when the detachable body is being attached to or detached from the detachable-body mounted member, wherein when the detachable body is being attached to the detachable-body mounted member, the second opening forming member compresses the sealing portion and the front end face of the second opening forming member presses the rear end face of the first opening-and-closing member to open the first opening, the following relationship is satisfied $$C<A+B$$

where A denotes a distance between (i) an engagement position between the first and second engagement members in a state where the detachable body is attached to the detachable-body mounted member and (ii) the rear and face of the first opening-and-closing member, B denotes a distance between the front end face of the second opening forming member and a front end face of the sealing portion in the mounting direction in an uncompressed state, and C denotes a distance between (i) the front end face of the second opening forming member and (ii) the engagement position between the first and second engagement members in the state where the detachable body is attached to the detachable-body mounted member.

24. The detachable body according to claim 23, wherein the sealing portion is provided around the second opening.

25. The image forming apparatus according to claim 23, wherein the sealing portion is in contact with the (i) and the (ii) when the first opening is opened.

26. The image forming apparatus according to claim 23, wherein the sealing portion is in contact with the (i) and the (ii) when the first opening-and-closing member is locked.

27. An image forming apparatus comprising:

a detachable-body mounted member that is supported by an image forming apparatus body;

a detachable body including an accommodating portion that accommodates developer therein, the detachable body being attachable to and detachable from the detachable-body mounted member in a mounting direction;

a first opening into which the developer flows;

a second opening;

an opening forming member formed around the second opening;

an opening-and-closing member that opens and closes the first opening; and a sealing portion, wherein when the first opening is opened, the sealing portion contacts with the opening forming member and the opening-and-closing member and elastically seals a gap between the opening forming member and the opening-and-closing member, the detachable-body mounted member includes the opening-and-closing member and the first opening, and the detachable body includes the opening forming member and the second opening.

28. An image forming apparatus comprising:

a detachable-body mounted member that is supported by an image forming apparatus body;

a detachable body including an accommodating portion that accommodates developer therein, the detachable body being attachable to and detachable from the detachable-body mounted member in a mounting direction;

a first opening into which the developer flows;

a second opening;

an opening forming member formed around the second opening;

an opening-and-closing member that opens and closes the first opening; and a sealing portion, wherein when the opening-and-closing member is locked, the sealing portion contacts with the opening forming member and the opening-and-closing member and elastically seals a gap between the opening forming member and the opening-and-closing member, the detachable-body mounted member includes the opening-and-closing member and the first opening, and the detachable body includes the opening forming member and the second opening.

29. An image forming apparatus comprising:

a detachable-body mounted member that is supported by an image forming apparatus body;

a detachable body including an accommodating portion that accommodates developer therein, the detachable body being attachable to and detachable from the detachable-body mounted member in a mounting direction;

a first opening into which the developer flows;

a second opening;

an opening forming member formed around the first opening;

an opening-and-closing member that opens and closes the second opening; and a sealing portion, wherein when the second opening is opened, the sealing portion contacts with the opening forming member and the opening-and-closing member and elastically seals a gap between the opening forming member and the opening-and-closing member, the detachable-body mounted member includes the opening forming member and the first opening, and the detachable body includes the opening-and-closing member and the second opening.

30. An image forming apparatus comprising:

a detachable-body mounted member that is supported by an image forming apparatus body;

a detachable body including an accommodating portion that accommodates developer therein, the detachable body being attachable to and detachable from the detachable-body mounted member in a mounting direction;

a first opening into which the developer flows;

a second opening;

an opening forming member formed around the first opening;

an opening-and-closing member that opens and closes the second opening; and a sealing portion, wherein when the opening-and-closing member is locked, the sealing portion contacts with the opening forming member and the opening-and-closing member and elastically seals a gap between the opening forming member and the opening-and-closing member, the detachable-body mounted member includes the opening forming member and the first opening, and the detachable body includes the opening-and-closing member and the second opening.

* * * * *